US010137045B2

(12) United States Patent
Hillenbrand, II et al.

(10) Patent No.: US 10,137,045 B2
(45) Date of Patent: Nov. 27, 2018

(54) PATIENT REPOSITIONING SYSTEM

(71) Applicant: Hillenbrand Management Company LLC, Batesville, IN (US)

(72) Inventors: William A. Hillenbrand, II, Batesville, IN (US); Timothy Savage, Batesville, IN (US); Joseph Kummer, Cincinnati, OH (US); Dale Foster, Guilford, IN (US); Jeffrey Woodall, Greenfield, IN (US); Andrew Rogier, Batesville, IN (US); Antonio Belton, Richton Park, IL (US)

(73) Assignee: Hillenbrand Management Company LLC, Batesville, IN (US)

( * ) Notice: Subject to any disclaimer, the term of this patent is extended or adjusted under 35 U.S.C. 154(b) by 315 days.

(21) Appl. No.: 14/942,380

(22) Filed: Nov. 16, 2015

(65) Prior Publication Data

US 2016/0067131 A1 Mar. 10, 2016

Related U.S. Application Data

(63) Continuation of application No. 13/837,185, filed on Mar. 15, 2013, now Pat. No. 9,205,012.

(51) Int. Cl.
*A61G 7/10* (2006.01)
*A47G 9/02* (2006.01)

(52) U.S. Cl.
CPC ..... *A61G 7/1026* (2013.01); *A47G 9/0238* (2013.01)

(58) Field of Classification Search
CPC ..... A61G 7/10
(Continued)

(56) References Cited

U.S. PATENT DOCUMENTS 659,755 A 10/1900 Moulton
2,761,153 A 9/1956 Mew
(Continued)

FOREIGN PATENT DOCUMENTS

GB 2198339 6/1988
JP S49-087409 U 7/1974
(Continued)

OTHER PUBLICATIONS

European Patent Office, Extended European Search Report, issued in corresponding EP Application No. 14767982.3, dated Dec. 6, 2016, 10 pgs.
(Continued)

*Primary Examiner* — Fredrick C Conley
(74) *Attorney, Agent, or Firm* — Wood Herron & Evans LLP

(57) ABSTRACT

A patient repositioning system for pulling a patient toward a head end of a bed includes a sheet, a mattress, and a housing which contains at least a part of a drive mechanism for operatively coupling to and pulling the sheet. The housing resides below a head end piece of the mattress, and is secured to the bed deck. The sheet pulling structure extends out of the housing via a slot and releasably attaches to the sheet, in a manner which has a low profile so as to pass through the slot. The sheet is longer than and wider than the mattress, and has beaded longitudinal side edges which are retained within rows of spaced retainers located on opposite sides of the mattress. During pulling of the sheet, the contoured shape of the housing facilitates movement of the sheet into the housing via the slot, even though the sheet width extends beyond the lateral edges of the mattress. The sheet may include indicia for indicating a "loaded" condition, and also usage indicia to indicate that it is time for a new sheet to be used.

47 Claims, 26 Drawing Sheets

(58) Field of Classification Search
USPC ..... 5/81.1 HS, 81.1 C, 81.1 RP, 81 R
See application file for complete search history.

(56) References Cited

U.S. PATENT DOCUMENTS

| | | | |
|---|---|---|---|
| 2,826,766 | A | 3/1958 | Stoner |
| 2,827,642 | A | 3/1958 | Huff |
| 3,383,717 | A | 5/1968 | Underwood |
| 3,466,679 | A | 9/1969 | Hess |
| 3,597,774 | A | 8/1971 | Warren |
| 3,641,600 | A | 2/1972 | Oats |
| 3,757,359 | A | 9/1973 | Stellman |
| 3,875,623 | A | 4/1975 | Johnston |
| 3,962,736 | A | 6/1976 | Fedele |
| 4,003,704 | A | 1/1977 | Zurolo et al. |
| 4,025,973 | A | 5/1977 | Walbrecht |
| 4,042,985 | A | 8/1977 | Raczkowski |
| 4,181,992 | A | 1/1980 | Blake |
| 4,747,170 | A | 5/1988 | Knouse |
| 4,776,047 | A | 10/1988 | DiMatteo |
| 4,796,313 | A | 1/1989 | DiMatteo et al. |
| 4,799,273 | A | 1/1989 | Elze |
| 4,819,283 | A | 4/1989 | DiMatteo et al. |
| 4,821,352 | A | 4/1989 | DiMatteo et al. |
| 4,837,872 | A | 6/1989 | DiMatteo et al. |
| 4,837,873 | A | 6/1989 | DiMatteo et al. |
| 4,843,665 | A | 7/1989 | Cockel et al. |
| 4,926,513 | A | 5/1990 | Oats |
| 4,939,798 | A | 7/1990 | Last |
| 4,941,220 | A | 7/1990 | DiMatteo et al. |
| 5,016,306 | A | 5/1991 | Grivna et al. |
| 5,020,171 | A | 6/1991 | DiMatteo et al. |
| 5,084,927 | A | 2/1992 | Parkevich |
| 5,103,512 | A | 4/1992 | DiMatteo et al. |
| 5,127,113 | A | 7/1992 | Di Matteo et al. |
| 5,155,874 | A | 10/1992 | Kershaw |
| 5,182,827 | A | 2/1993 | Carrier et al. |
| 5,184,112 | A | 2/1993 | Gusakov |
| 5,185,894 | A | 2/1993 | Bastert et al. |
| 5,239,713 | A | 8/1993 | Toivio et al. |
| 5,280,657 | A | 1/1994 | Stagg |
| 5,319,813 | A | 6/1994 | DiMatteo et al. |
| 5,325,554 | A | 7/1994 | Lewis |
| 5,377,391 | A | 1/1995 | Foster |
| 5,469,588 | A | 11/1995 | DiMatteo et al. |
| 5,499,859 | A | 3/1996 | Angell |
| 5,608,929 | A | 3/1997 | Crane |
| 5,692,256 | A | 12/1997 | Kramer et al. |
| 5,692,272 | A | 12/1997 | Woods |
| 5,697,109 | A | 12/1997 | Hodgetts |
| 5,718,009 | A | 2/1998 | Lin |
| 5,737,781 | A | 4/1998 | Votel |
| D402,434 | S | 12/1998 | Votel |
| 5,890,238 | A | 4/1999 | Votel |
| 5,901,388 | A | 5/1999 | Cowan |
| 5,996,144 | A | 12/1999 | Hodgetts |
| 6,058,533 | A | 5/2000 | Nelson |
| 6,282,734 | B1 | 9/2001 | Holberg |
| 6,289,533 | B1 | 9/2001 | Hodgetts |
| 6,341,393 | B1 | 1/2002 | Votel |
| 6,357,065 | B1 | 3/2002 | Adams |
| 6,363,555 | B1 | 4/2002 | LaRose |
| 6,378,148 | B1 | 4/2002 | Votel |
| 6,496,991 | B1 | 12/2002 | Votel |
| 6,499,156 | B1 | 12/2002 | Dirst |
| 6,594,837 | B2 | 7/2003 | Khait |
| 6,611,974 | B2 | 9/2003 | Roit et al. |
| 6,615,423 | B2 | 9/2003 | Sverdlik et al. |
| 6,629,323 | B2 | 10/2003 | Sverdlik et al. |
| 6,772,456 | B2 | 8/2004 | Votel |
| 7,003,819 | B2 | 2/2006 | Weigand |
| 7,111,338 | B2 | 9/2006 | Faux et al. |
| 7,191,479 | B1 | 3/2007 | Cheng |
| 7,225,489 | B1 | 6/2007 | Frickey et al. |
| 7,293,303 | B2 | 11/2007 | Worrell |
| 7,305,725 | B2 | 12/2007 | Burton |
| 7,337,478 | B1 | 3/2008 | Lake |
| 7,458,113 | B2 | 12/2008 | Milam |
| 7,487,558 | B2 | 2/2009 | Risk, Jr. et al. |
| 7,725,964 | B2 | 6/2010 | Minning et al. |
| 7,805,782 | B2 | 10/2010 | Hakamiun et al. |
| 7,992,237 | B2 | 8/2011 | Minning et al. |
| 8,087,109 | B2 | 1/2012 | Hillenbrand, II |
| 8,156,582 | B2 | 4/2012 | Rupar et al. |
| 8,250,686 | B2 | 8/2012 | Minning et al. |
| 8,453,276 | B2 | 6/2013 | Hillenbrand, II |
| 8,584,288 | B2 | 11/2013 | Shaw |
| 2002/0029418 | A1* | 3/2002 | Votel ..... A61G 7/1019 5/81.1 RP |
| 2002/0083521 | A1 | 7/2002 | Sverdlik et al. |
| 2003/0110559 | A1 | 6/2003 | Weigand |
| 2005/0138727 | A1 | 6/2005 | Faux et al. |
| 2005/0217023 | A1 | 10/2005 | Tally |
| 2005/0235415 | A1 | 10/2005 | Pedersen et al. |
| 2006/0273292 | A1 | 12/2006 | Milam |
| 2009/0056012 | A1 | 3/2009 | Brossart et al. |
| 2009/0255057 | A1* | 10/2009 | Rupar ..... A61G 7/1032 5/81.1 HS |
| 2010/0281613 | A1 | 11/2010 | Hillenbrand, II |
| 2011/0072582 | A1 | 3/2011 | Patterson et al. |
| 2012/0139395 | A1 | 6/2012 | Dietrich |
| 2012/0144581 | A1 | 6/2012 | Roberg |
| 2012/0297544 | A1 | 11/2012 | Griswold et al. |
| 2012/0299353 | A1 | 11/2012 | Griswold et al. |
| 2013/0025048 | A1 | 1/2013 | Pruett |
| 2013/0191990 | A1 | 8/2013 | Minning et al. |

FOREIGN PATENT DOCUMENTS

| | | | |
|---|---|---|---|
| JP | S56-141615 | U | 10/1981 |
| JP | S59-015806 | U | 1/1984 |
| JP | S63-153061 | A | 6/1988 |
| JP | A2003-199661 | | 7/2003 |
| JP | A2010-005208 | | 1/2010 |
| WO | 99/30662 | A1 | 6/1999 |
| WO | 0023026 | A2 | 4/2000 |

OTHER PUBLICATIONS

European Patent Office, Supplementary Partial European Search Report, issued in corresponding EP Application No. 14767982.3, dated Oct. 14, 2016, 6 pgs.

International Searching Authority, Search Report and Written Opinion issued in International Application No. PCT/US2015/043608 dated Oct. 23, 2015, 12 pgs.

International Searching Authority, Search Report and Written Opinion issued in International Application No. PCT/US2015/043618 dated Oct. 23, 2015, 11 pgs.

International Searching Authority, Search Report and Written Opinion issued in International Application No. PCT/US15/20489 dated Jun. 22, 2015, 7 pgs.

International Searching Authority, Search Report and the Written Opinion issued in PCT Application No. PCT/US2014/055821, dated Dec. 22, 2014, 14 pgs.

International Searching Authority, Search Report and Written Opinion issued in International Application No. PCT/US2014/018231 dated Jun. 18, 2014, 14 pgs.

Japanese Patent Office Decision of Rejection issued in Japanese Application No. 2016-500376 dated Sep. 3, 2018, 7 pages.

* cited by examiner

PATIENT REPOSITIONING SYSTEM

CROSS-REFERENCE TO RELATED APPLICATION

This application claims priority to U.S. patent application Ser. No. 13/837,185, entitled "Patient Positioning System," filed on Mar. 15, 2013, the disclosure of which is expressly incorporated by reference herein in its entirety.

FIELD OF THE INVENTION

The present invention relates to a system and method for patient repositioning, and more particularly, to a safe, efficient and user-friendly system and method for repositioning a patient by moving the patient toward a head end of a bed.

SUMMARY OF THE DISCLOSURE

Since at least the 1950's, it has been recognized that a person supported on an articulating bed, such as a hospital bed or other type of conventional health care bed, tends to migrate from the head end of the bed toward the foot end of the bed when the head end of the bed is raised. Generally, this problem has been addressed by moving the patient back toward the head end of the bed, either by manually lifting and pulling the patient or by using a lifting device to move the patient.

The problems associated with manually pulling a patient are well-recognized, and include potential injury to the puller, i.e., the caregiver(s), often one or more nurses. And certain factors can further aggravate this problem, such as a shortage of nurses and/or an obese or uncooperative patient.

In addition to manual repositioning of a patient, a significant number of prior devices have been devised in an effort to solve this problem. For instance, U.S. Pat. Nos. 2,827,642; 4,796,313; 4,799,273; 4,819,283; 5,020,171; 5,697,109; 5,737,781; 6,615,423; 6,722,456; 2005/0217,023; 7,003,819; 7,293,303; 7,487,558; 7,725,964; and 2012/0144581 show and describe some examples of such prior structures. Some of these devices use a hand crank to manually wind a bed sheet toward the head end of a bed, with the patient supported thereon. Some use the bed frame and/or the headboard of the bed. Some use pulleys and/or suspension devices. But despite the relatively high number of devices which purport to resolve the above-described problem, applicants are unaware of any commercially viable product on the U.S. market which adequately addresses this problem. In other words, despite the seemingly simple nature of this problem, and the multiple and well-documented prior efforts at solving this problem, this problem has not been adequately solved.

Prior U.S. Pat. No. 8,087,109, entitled "Patient Positioning Device," which is expressly incorporated by reference herein, in its entirety, represents a significant step toward solving this problem. The '109 patent discloses, in general, a device which pulls a sheet and a patient supported thereon toward the head end of the bed, with the sheet guided on opposite sides by a pair of spaced tracks which hold opposite side edges of the sheet. The owner of this present application also owns the '109 patent.

The present application represents a further advance in this field, with a safe, practical, robust, yet user-friendly solution to the above-described problem. Generally, the present invention achieves the solution to this problem by the cooperative interaction of three main components, namely, a mattress, a sheet, and a sheet receiver for pulling the sheet toward a head end of the mattress. Generally, in the context of this specification, the sheet receiver encompasses a housing and a drive mechanism. The mattress has a movable head end piece, i.e., preferably foldable about a fold line, which moves to enable access to the housing and the drive mechanism contained therein. The housing includes an access door to enable a user to readily access a sheet chamber within the housing.

With this arrangement, by folding the head end piece of the mattress and by opening the access door to the housing, a user may readily access the sheet chamber without any accompanying need to articulate a deck on which the mattress and the housing reside. This structure greatly facilitates cleaning and maintenance of the components located within the housing. In the hospital environment, over the past few years infection control has become increasingly more important. By providing simple and easy access to these components, this system and method helps the user to take steps to fight against instances of infection. But at the same time, the housing protects the components located therein, and does so within a volume that does not interfere with a standard bed deck, to which the housing is preferably secured.

This system and method also facilitates the simple and repeatable attachment of the sheet to be pulled with the pulling device, which is located in the housing. In fact, this system and method eliminates the need to raise the head end of the mattress, or to articulate the bed, in order to change the sheet, to disinfect the housing and the components located within the housing for infection control.

More specifically, the housing includes a slot through which at least one connector extends, to connect to a head end of the sheet, and thereby enable the sheet to be pulled into the housing when attached to the connector. The connector may include one or more straps. The slot is preferably defined in part by the access door of the housing, to facilitate routing of the connector to the sheet for attachment. The housing also includes one or more contoured surfaces located adjacent the slot, to facilitate movement of the sheet by reducing the friction on the sheet and compression of the mattress as the sheet moves toward and into the slot. Also, the top head end surface of the mattress, at the corner, may have reduced elasticity to facilitate slidability of the sheet thereover as it is pulled toward the slot.

The sheet has a length that is significantly longer than the mattress, to enable multiple repositioning operations with the same sheet. Also, the sheet has a width that is greater than that of the mattress, and has opposing beaded edges, with each beaded edge retained along one outer side of the mattress by a plurality of spaced retainers secured to the mattress. Each of the retainers has an open position to enable placement of the beaded edge of the sheet therein, and a closed position to retain the beaded edge therein. In the closed position, the retainers permit the sheet to be pulled toward the head end of the mattress. In this preferred embodiment, by locating the retainers on the outer sides of the mattress, the entire top surface of the mattress is available for use by the patient, without obstruction. In addition, with this embodiment there are no obstructions along the perimeter of the top surface of the mattress. The retainers also manage the sheet's longitudinal perimeter, by preventing the upper ticking from becoming exposed. This management also creates a stable surface for the patient during ingress, egress and transfer.

The sheet includes at least one reinforced slit, to which a T-shaped tab is removably attachable, the T-shaped tab located at an outer end of a connector. The T-shaped tab quickly and easily slides within the reinforced slit, to enable pulling of the connector toward the head end of the mattress to also pull the sheet toward the head end. The other end of the connector is secured inside the housing, for instance, to a roller mounted therein, whereby rotation of the roller pulls the connector and the sheet attached thereto into the housing via the slot. The connector and the sheet wrap around the roller within the housing. Each repositioning of the patient causes more of the sheet length to wrap around the roller located in the housing.

By collecting the used sheet within the housing, this system and method accommodates multiple repositionings of the patient, without any commensurate entanglement of that portion of the sheet that has already been used. At the same time, the location and the shape of the housing, relative to the top surface of the mattress, eliminate the need for the sheet to span between various bed structures, and thereby create the potential for interference between the sheet and surrounding bed structures.

According to one aspect of the invention, the attachment structure between the connector and the sheet, i.e., the T-shaped tab and the reinforced slit, is designed so as to have a very small profile. This small profile facilitates movement of the attachment structure into the slot of the housing, to enable the connector and a head end of the sheet to sufficiently wrap around the roller so that, upon further rotation of the roller, the sheet is pulled toward the head end of the bed with enough pulling force to also pull a patient supported on the sheet. For example, the structure that is shown and described herein, i.e., two pairs of reinforced slits oriented longitudinal to the length of the sheet, and each of two T-shaped tabs located at the outer ends of two straps which are secured to the roller, is capable of pulling a patient in excess of 500 pounds. According to this aspect of the invention, the initial attachment of the connector to the sheet and the initial pulling of the sheet into the housing essentially "loads" the system, for subsequent pulling of the sheet in a weighted condition, i.e., with a patient supported thereon.

Still further, in association with this aspect of the invention, the sheet includes "loaded" indicia, to indicate (for instance, to visibly indicate) to the user when the sheet has been sufficiently pulled into the housing to achieve adequate "loading." The sheet loading indicia can be located on either side of the sheet, and preferably is discernable through the sheet, so that the sheet can be used with either side facing upwardly. In addition, the sheet loaded indicia can be arranged or located so as to match up with, or become aligned with, corresponding mattress indicia located on the mattress. The alignment of these two corresponding sheet and mattress indicia serves to indicate when the sheet has been loaded. The Figures of this application show visible indicia, for both the sheet loaded indicia and the mattress indicia. The sheet may also include additional sheet usage indicia, to indicate the amount of sheet remaining at the foot end of the bed, and when the excess length of sheet at the foot end has been exhausted, such that it is time to replace the existing sheet with a new sheet. The sheet usage indicia may be numerical, color coded, or symbolic, as examples.

Alternatively, the controller included with the drive mechanism may include a counter which counts the number of times the sheet has been repositioned, i.e., for instance, by the number of rotations of the roller, thereby to provide an indication when the sheet needs to be replaced after a predetermined number of rotations. Still further, the housing may include a sensor, operatively connected to the controller, which is adapted to sense and to convey to the controller one or more of: the sheet loaded indicia, the sheet usage indicia, or perhaps other indicia, such as indicia to assure that a properly sized sheet, i.e., a compatible sheet, has been attached.

The mattress includes two rows of spaced retainers, for holding opposite sides of the sheet as the sheet is moved toward the head end of the mattress to reposition the patient. The use of a plurality of spaced retainers provides a significant advantage in everyday use. More specifically, in a hospital setting, there are a significant and consistent number of situations wherein a sheet must be replaced while the patient remains on the mattress of the bed. Applicants are aware of studies which state that this occurs frequently. With the system and method described in this specification, a caregiver can secure one edge of the sheet to one side of the mattress via the retainers, then tuck the sheet underneath the patient for subsequent securement of the other edge of the sheet to the retainers on the opposite side of the mattress. When the sheet is secured in this manner, enough "slack" can be left at the head end of the sheet, as indicated by the sheet loading indicia, to enable the system to become loaded without having to pull any portion of the sheet which is supporting the patient. In other words, only the slack at the head end of the sheet is pulled. Thus, this system and method can readily accommodate the repositioning of a patient in those situations where a sheet must be replaced while the patient remains on the bed. In other words, with this system and method it is not necessary to connect both sides of the sheet at the foot end of the mattress, and to then simultaneously move both connected sides of the sheet toward the head end, along parallel continuous tracks.

According to another aspect of the invention, the retainers have a base piece secured to the mattress (or to a ticking which comprises the outer cover and surface for the mattress) and a movable piece which connects to the base piece and moves relative thereto. The movable piece moves between a closed position which defines a channel for retaining the beaded edge of the sheet, and an open position which opens the channel to allow the sheet to be released. In the closed position, the channel allows movement of the sheet toward the head end of the bed. According to yet another aspect of this invention, the pieces of the retainers have a detented position to identify when the movable piece is properly located in the closed position. The spaced retainers are located along the sides of the mattress, preferably in locations that are displaced from the rails of a conventional health care bed.

Although it is contemplated that various types of drive mechanisms would work with this system and method, one suitable drive mechanism includes a power supply, a controller, a drive train, and gears located entirely within the housing, and operable to cause the driven components, in this case a roller and two connector straps, to rotate so as to pull the sheet into the housing. The controller operatively connects to inputs mounted on the external surface of the housing, to enable a user to operate the system. Preferably, an arrestor, which could be a clutch, holds the roller in a fixed position, to thereby prevent the sheet from being pulled downwardly toward the foot end of the bed, i.e., to prevent unwinding of the sheet from the roller. With this structure, to reposition the patient the controller is enabled, as by depressing an enabling (or "start") pushbutton, and then a reposition button is depressed to activate the drive mechanism to rotate the roller. Because of the need for a user to actively interface with two separate controls, this system and method provides a significant degree of safety in repositioning the patient. Further, to reposition the sheet towards the foot end of the mattress, or to remove the sheet, the arrestor is released which enables the roller to freewheel in a direction to allow the sheet to be pulled from the housing.

Nonetheless, other structures or components could be used, in the alternative, to supply the degree of safety needed. Still further, a safety stop device, such as a disabling sensor and/or switch, can be incorporated into the system to prevent inadvertent movement of the patient too close to the head end of the mattress, or to the headboard. It may also be desirable to incorporate a separate sensor into the system, to disable the drive mechanism unless the head end of the mattress is oriented horizontally, or at least below a predetermined angle relative to horizontal.

Regardless of the particular drive mechanism used, when movement of the sheet toward the head end stops, the system permits reversal of the drive mechanism to permit the sheet to pull back toward the foot end of the bed. This reversal releases the tension in the sheet and enhances patient comfort.

According to another aspect of the invention, it would be possible to reduce the overall cost of the system by reducing the number of components located within the housing itself, perhaps by locating only the passive driven components within the housing and perhaps one or more components which couple to the driven components. In this respect, a separate hand held unit could be used from outside the housing to interface with the passive components, i.e., a roller, or other pulling device or sheet take-up structure located inside the housing, thereby to drive the passive components located in the housing so as to reposition the sheet and the patient residing thereon. Thus, multiple products could be operated by a single hand held unit. And for a facility with a significant number of beds, this option would reduce overall costs by eliminating the need to locate some or all of the active drive components in each housing.

At the foot end of the mattress, a barrier may be used to support and isolate the unused and remaining part of the sheet. This barrier may be connected to the mattress, the bed frame, and/or the footboard. This barrier can also serve as a spacer between the foot end of the mattress and the bed frame, typically the footboard, to provide unobstructed movement of the sheet. Alternatively, the barrier and the spacer can be separate structures.

As shown and described herein, the sheet is wider than the mattress and also wider than the housing. Nevertheless, the drive mechanism pulls the extra sheet width, on both sides, around the corners of the mattress at the head end thereof and into the housing via the slot. The contours of the housing, at the head end and at the corners, facilitate movement of the sheet toward the slot. To achieve this contoured affect, the head end of the housing may include a curved extension that extends slightly beyond the head end of the mattress. This creates a "waterfall" effect to prevent against the entry of foreign objects into the slot. This extension can also serve as the head end boundary for the head end of the mattress, and also reduces compression of the head end of the mattress.

The transverse dimension of the slot needs to be able to accommodate some amount of sheet overlap, or doubling over of the sheet, near the outer ends. Moreover, within the housing itself, the roller may have a reduced diameter at its outer ends, thereby to provide additional internal clearance within the housing to accommodate this extra sheet width. Nonetheless, the width of the slot is still sufficiently small, i.e., preferably about 8 mm, to prevent the accidental ingress into the housing of a user's finger or medical tubes or wires. Additionally, a safety cut-off switch may be incorporated into the system, particularly to disable the drive mechanism, so as to discontinue rotation of the roller upon detection of a higher than normal resistance.

The mattress has a head end section of reduced thickness, and is complementary in shape with the housing, at least with respect to a central longitudinal vertical plane. The head end section may contain a foldable head end piece defined by a fold line, and foldable about the fold line to access the housing. Alternatively, the head end piece could be removably connected to the mattress along the "fold line." The head end section of the mattress may be firmer than the rest of the mattress, to further protect a patient from the housing residing therebelow. An increased firmness of the head section may also increase the wear resistance of the head end section as the sheet is pulled over the edge of the mattress. To further protect against mattress head section wear, a portion of the housing is adjacent the head end of the mattress to limit the compressibility of the mattress as the sheet is advanced. In an alternative embodiment, the mattress head section does not have a reduced thickness. Instead, the housing is integrated into the head section of the bed deck. In this embodiment, the access door of the housing may be incorporated into the bed deck.

With this patient repositioning system, according to the preferred embodiments, the structure which pulls the sheet does not contact or interact with the bed frame or the headboard of the bed. Instead, because of the complementary shape of the mattress and the housing, the system primarily operates within the space envelope of the mattress. Preferably, the housing is removably mounted to the deck of the bed, thereby to assure its physical position relative to the mattress during articulation of the bed into various positions. Regardless of the position of the deck, the housing can be accessed by moving the head end piece of the mattress. Additionally, because the hinged access door partially defines the slot in this embodiment, this structure simplifies the proper routing and/or orienting of the connectors, namely the straps, prior to their releasable attachment to the sheet. Overall, this structure helps to assure a safe, simple, efficient, user-friendly, and repeatable attachment of the sheet to the drive mechanism. This structure also facilitates the user's ability to practice effective infection control.

The system and method disclosed herein is not limited to use with a conventional health care bed having a flat deck. Rather, this invention may be readily adaptable for use in combination with a type of hospital bed known as a "step-deck" bed, as shown in U.S. Pat. No. 5,6662,256, a birthing bed which is specifically adapted for use when a mother gives birth to an infant, or even with a bariatric bed. For these variations of the invention, the mattress and the housing are reoriented and/or reconfigured to accommodate the different bed shapes, and particularly the different shapes of the deck and/or the mattress. With these various bed designs, the patient repositioning system may be integrated at least partially into the bed deck.

Those skilled in the art will more readily understand the scope and content of this specification in view of the following drawings and the detailed description of those drawings.

DETAILED DESCRIPTION OF THE DRAWINGS

Figure 1A:
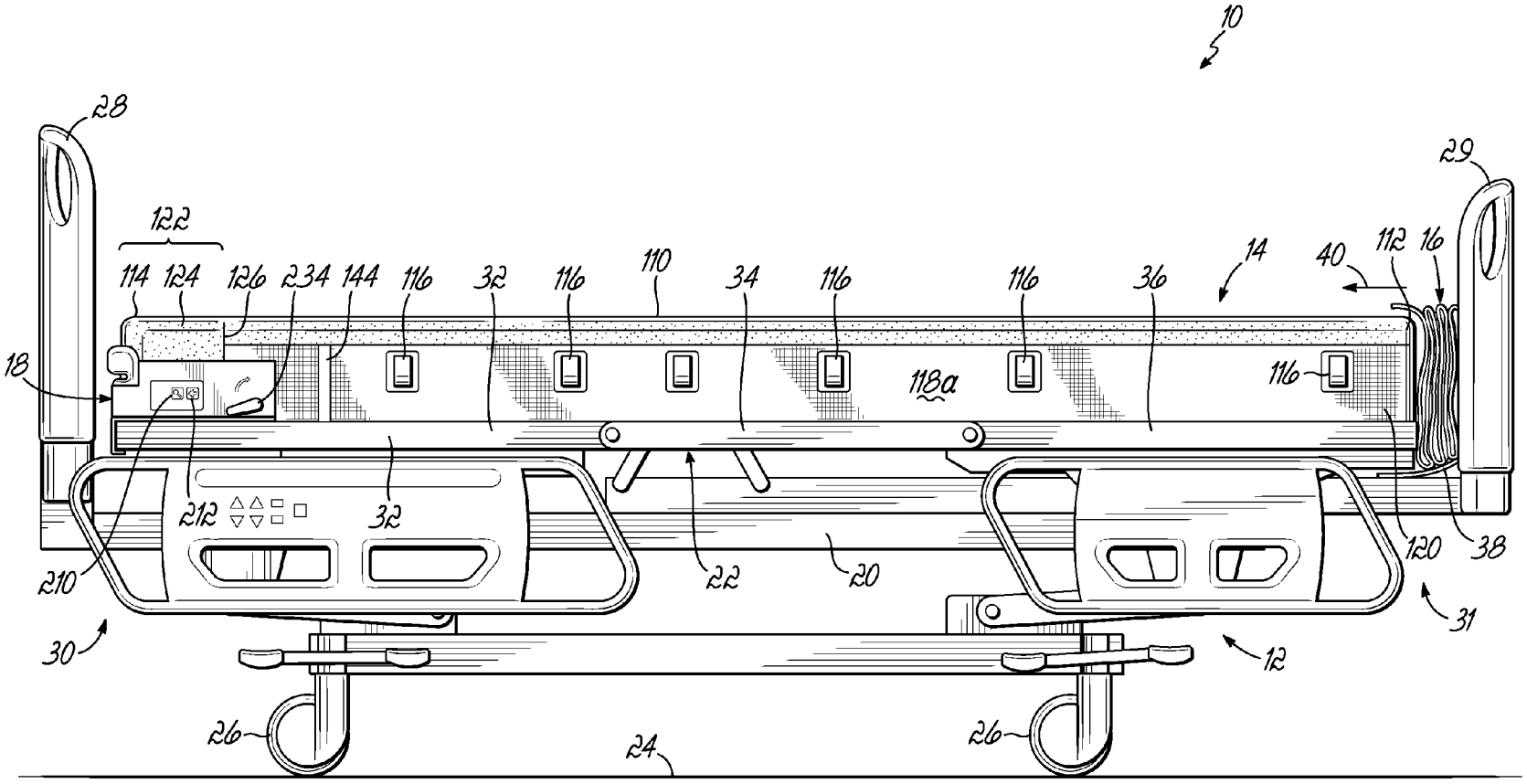
FIG. 1A is a side view of a patient repositioning system for use with a health care bed, according to one exemplary, preferred embodiment of the invention.

With reference to FIG. 1A, an embodiment of a patient repositioning system 10 for use with a health care bed 12, such as a hospital bed, includes a mattress 14, a sheet 16, and a sheet receiver 18. As noted previously, the sheet receiver generally encompasses a housing and a drive mechanism. The exemplary health care bed 12 is more particularly an articulating bed commonly used in hospitals, nursing homes, private homes, or any other environment where patient care is enhanced through the use of the articulating bed. Common articulating beds, such as the health care bed 12, include a frame 20 for supporting a bed deck 22 above a floor 24. According to the exemplary embodiment, the frame 20 also includes a plurality of wheels 26 to more easily move the health care bed 12 in preparation of or during patient care. The health care bed 12 also includes a headboard 28 and footboard 29 each removably attached to a respective head end 30 and foot end 31 of the health care bed 12. With respect to the use of the terms "head" or "head end" and "foot" or "foot end," it will be appreciated that such directions are intended to describe relative locations along exemplary embodiments of the patient repositioning system 10 positioned along the health care bed 12. It is not intended that the terms "head end" and "proximal end" limit the invention to any of the exemplary embodiments described herein.

The sheet receiver 18, mattress 14, and sheet 16 are each positioned adjacent to the bed deck 22 as shown in FIG. 1A. More particularly, the bed deck 22 includes a head deck portion 32, a central deck portion 34, and a foot deck portion 36. Each of the head deck, central deck, and foot deck portions 32, 34, 36 are pivotably connected together for use as the articulating bed. The mattress 14 rests directly upon the bed deck 22 similar to a traditional mattress. However, unlike a traditional mattress, the sheet receiver 18 is secured to the head deck portion 32 below a portion of the mattress 14, while the sheet 16 may be partially stowed between the mattress 14 and the footboard 29. FIG. 1A shows the sheet receiver 16 entirely below a top surface of the mattress 14. But in the context of this specification "below" means at least in part below, as in at least in part below the top surface of the mattress. The sheet receiver 18 also releasably attaches to the mattress 14 for reducing the likelihood of inadvertent relative movement therebetween. For example, the sheet receiver mattress 14 may attach to the mattress 14 via cooperating structures such as hook and loop fasteners, snaps, magnets or any other structure for releasably attaching one surface to another. According to the exemplary embodiment, a barrier 38 attaches to the frame 20 below the foot deck portion 36 and extends toward the footboard 29. Accordingly, the barrier 38 supports at least a portion of the sheet 16 resting between the mattress 14 and the footboard 29. While the health care bed 12 may be the articulating bed shown in the exemplary embodiment, it will be appreciated that the patient repositioning system 10 may also be used with other beds, such as stepped deck beds and birthing beds, which will be described below in further detail.

As indicated by arrow 40 in FIG. 1A, the sheet 16 is pulled onto an upper surface 110 of the mattress 14 from a mattress foot end 112 to a mattress head end 114, where the sheet 16 feeds into the sheet receiver 18. More particularly with respect to FIG. 1B, a beaded edge 510*a* on a sheet longitudinal side 512*a* is slidably positioned within a row of retainers 116. The row of retainers 116 is located along a mattress longitudinal side 118*a* for guiding the sheet 16 between the mattress foot and head ends 112, 114. The retainers 116, described further below, may be spaced along the mattress 14 in generally any orientation that both holds the sheet 16 and allows for operator access to the retainers around various components of the health care bed 12. The sheet 16 is similarly received by another row of retainers (not shown) on an opposing mattress longitudinal side 118*b* (see FIG. 2).

Figure 1B:
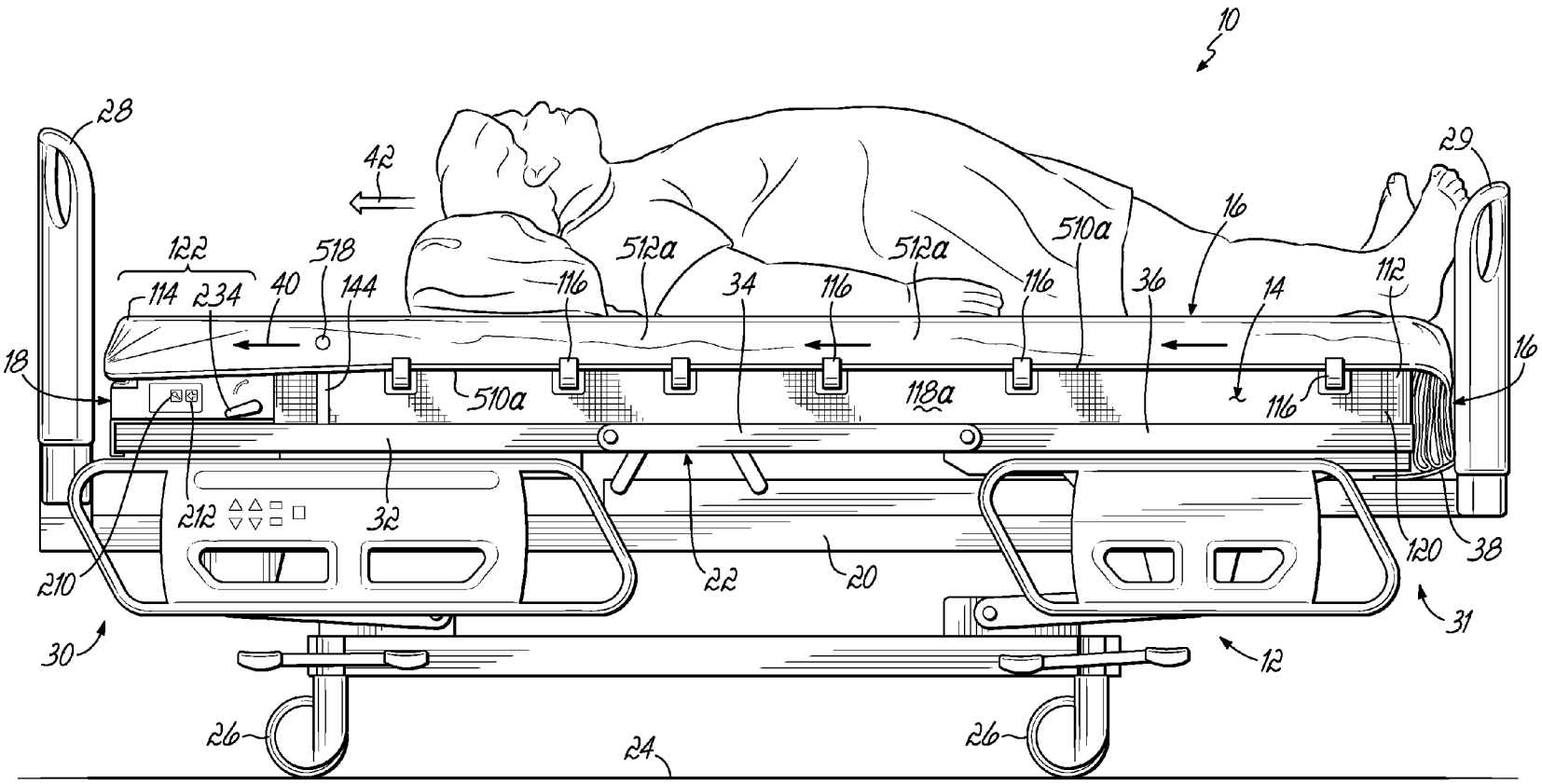
FIG. 1B is the side view of the patient repositioning system shown in FIG. 1A, with a patient residing on the health care bed near the foot end.

A patient is shown in FIG. 1B resting on the sheet 16 in a foot end position after having migrated from a head end position. Generally, the term "head end position" refers to a preferred patient position closer to the mattress head end 114 than the mattress foot end 112. Similarly, the term "foot end position" generally refers to any position of the patient after migrating from the mattress head end 114 toward the mattress foot end 112. It will be appreciated, however, that the terms head end position and foot end position are merely exemplary and intended to show distinguishing positions in which to move the patient. As such, the invention is not intended to be limited to the head and foot end positions shown.

An operator, such as a caregiver or an attendant, may desire to return the patient to the head end position. Frequently, moving the patient from the foot end position to the head end position may require manually gripping and pulling a sheet, on which the patient rests, toward the headboard 28. However, the patient repositioning system 10 automatically repositions the patient to the head end position under direction by the operator. According to the exemplary embodiment, the operator enables the patient repositioning device 10 by activating an enabling switch 210 operatively connected to the sheet receiver 18. Once enabled, the operator then activates a drive switch 212 operatively connected to the sheet receiver 18. With both the enabling switch 210 and drive switch 212 activating, the sheet receiver 18 pulls the sheet along the upper surface 110 toward the head board 28, as indicated by arrows 42. Because the patient is resting on the sheet 16 as it moves, the patient similarly moves away from the footboard 29 and toward the headboard 28, as indicated by arrow 42. The patient is moved toward the headboard 28 until reaching the desired head end position shown in FIG. 1C. Of course, in the event that the patient again migrates toward the foot end position, the operator may repeat the operation of repositioning the patient with the patient repositioning system 10 as desired.

Figure 2:
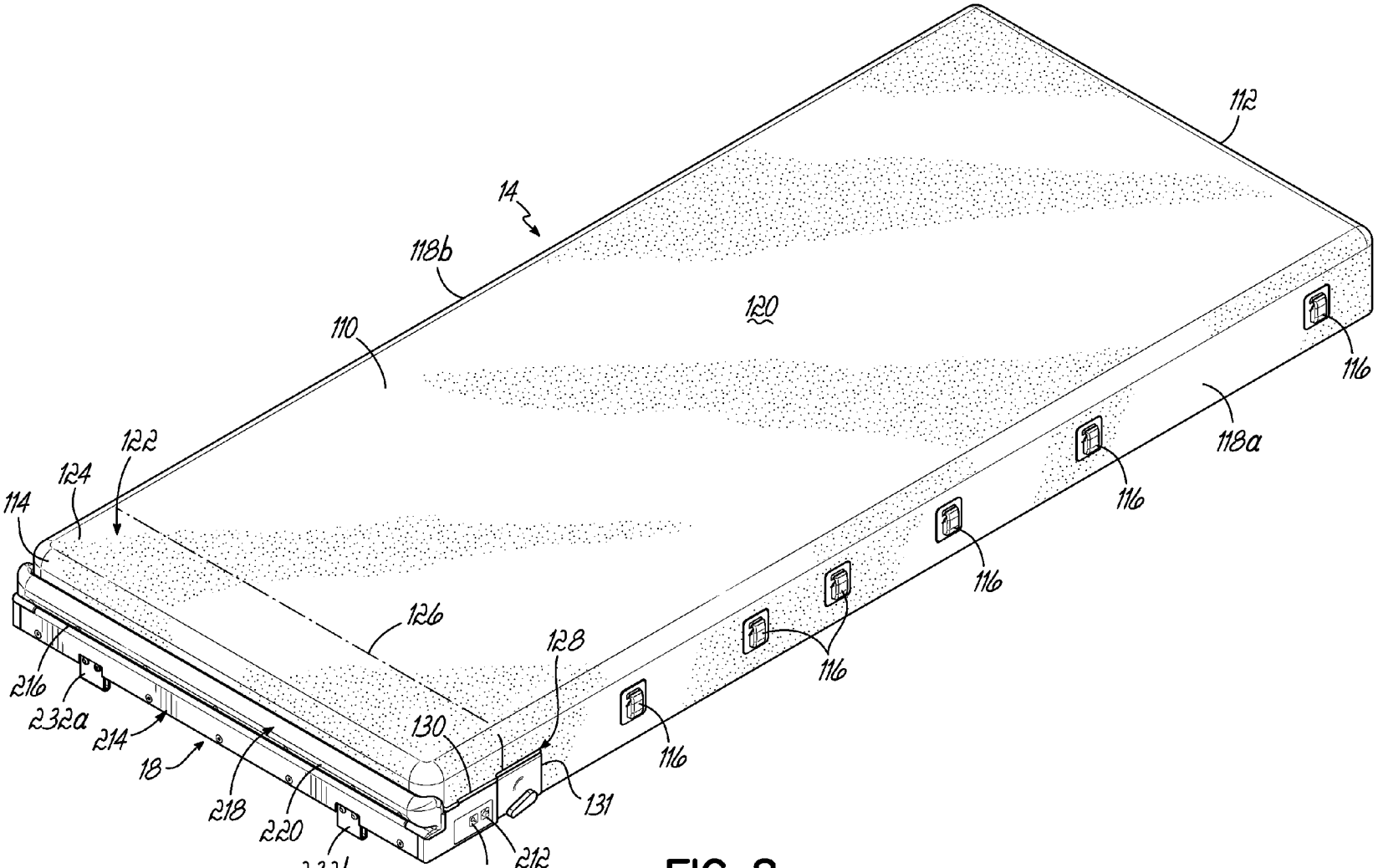
FIG. 2 is a perspective view of a mattress complementarily positioned against a sheet receiver, and more particularly the housing, according to the embodiment shown in FIG. 1A.

With respect to FIG. 2, the mattress 14 for repositioning the patient generally includes the mattress foot end 112, the mattress head end 114, the upper surface 110, and the pair of longitudinal sides 118*a*, 118*b* as described above. Generally, the pair of longitudinal sides 118*a*, 118*b* is symmetric with a generally uniform thickness, while the upper surface 110 has a substantially uniform width and length. The mattress 14 is also covered in an outer ticking 120 for effectively improving the life and comfort of the mattress 14. In addition, each of the retainers 116 is attached to the outer ticking 120 of the mattress 14 in spaced relation along the length of the mattress longitudinal sides 118*a*, 118*b*. However, the mattress head end 114 also includes a head end section 122 of reduced thickness relative to the generally uniform thickness of the remaining mattress 14. In this respect, the head end section 122 is a relatively thin portion of the mattress 14 and further includes a head end piece 124. The head end piece 124 folds about a fold line 126 relative to the rest of the mattress 14 for improving access to the sheet receiver 18 below the upper surface 110 of the mattress head end 114. Further details concerning access to the sheet receiver 18 will be further discussed below with respect to FIG. 6. However, it will be appreciated that other respective portions of the mattress 14 may be otherwise movable for accessing the sheet receiver 18.

Furthermore, at least a portion of the sheet receiver 18 is positioned within a volume envelope 128 (see FIG. 7B) of the mattress 14 for effectively reducing an overall footprint of the mattress 14 and sheet receiver 18. The reduced thickness of the head end section 122 has a lower surface 130 and a forward surface 131 that collectively define the volume envelope 128 that would otherwise be occupied by the mattress 14 if not for the head end section 122 of reduced thickness. Thereby, the head end section 122 is complementary in shape to a housing 214 of the sheet receiver 18.

Figure 7A:
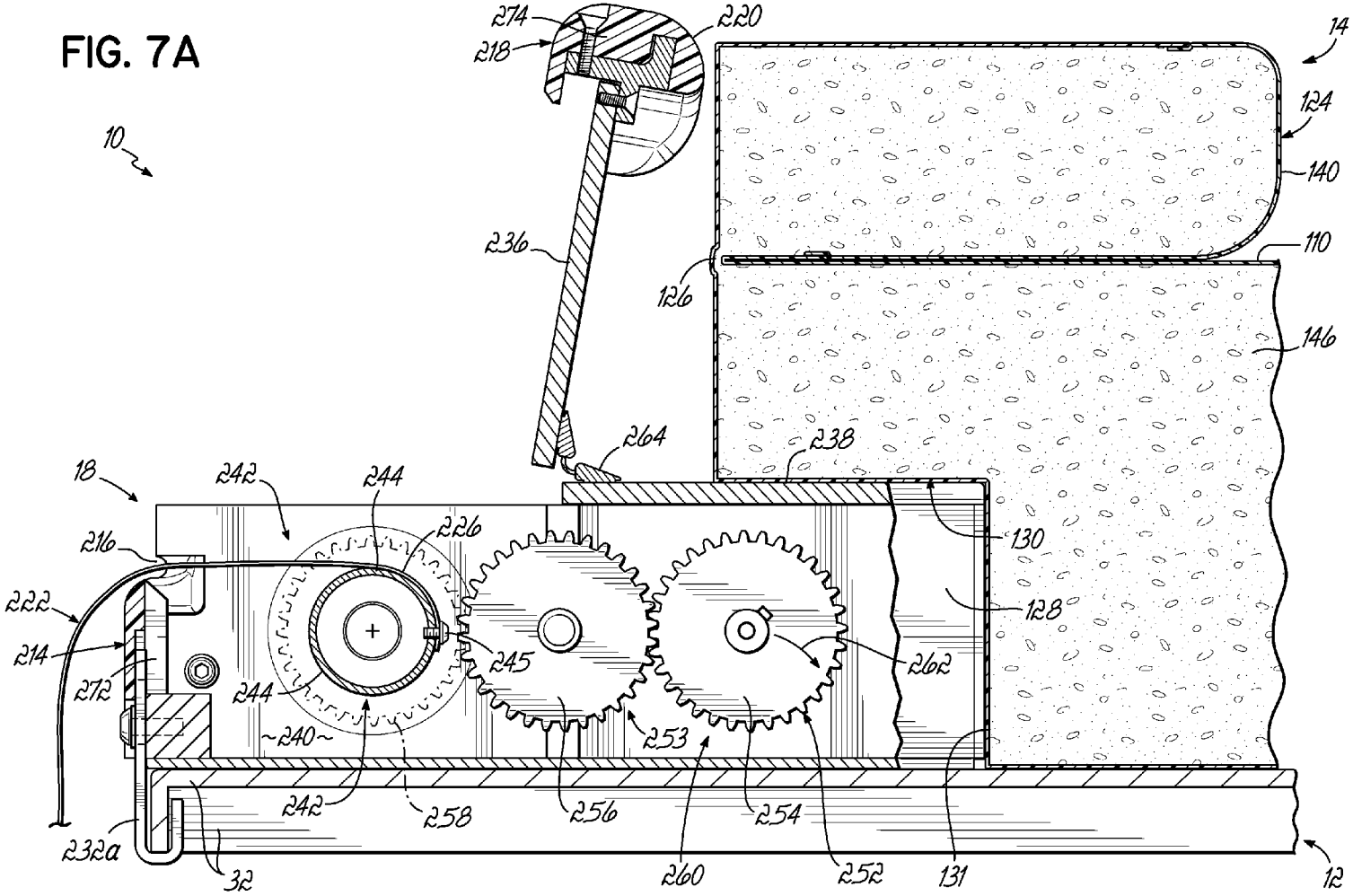
FIG. 7A is a schematic cross sectional view of the sheet receiver and the head end piece of the mattress shown in FIG. 6, with the connecting structure extending out of the sheet receiver and the access door open.
Figure 7B:
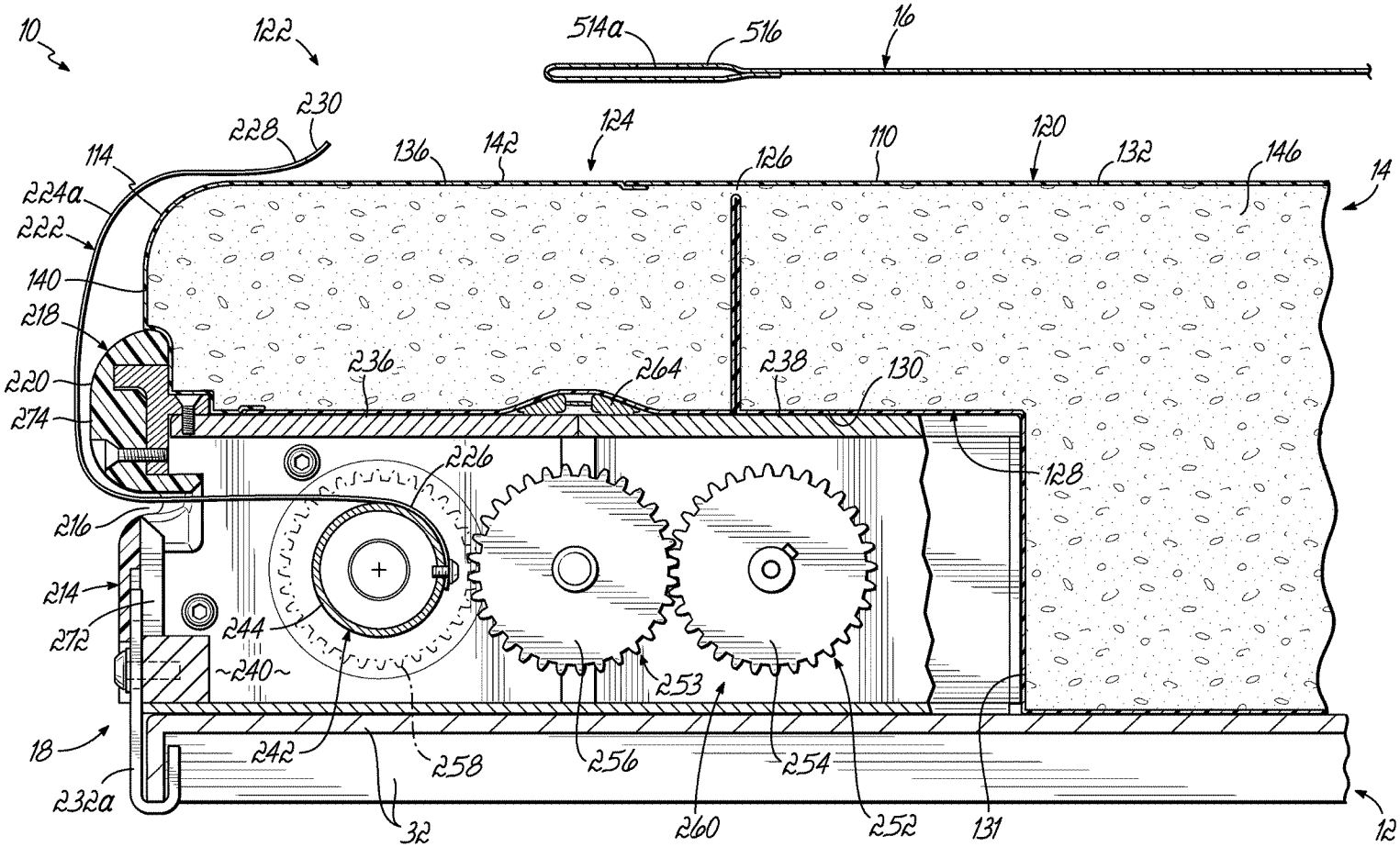
FIG. 7B is a schematic cross sectional view, similar to FIG. 7A, with the access door of the sheet receiver in a closed position, the connecting structure extending upwardly, and a sheet located above the surface of the mattress.
Figure 7C:
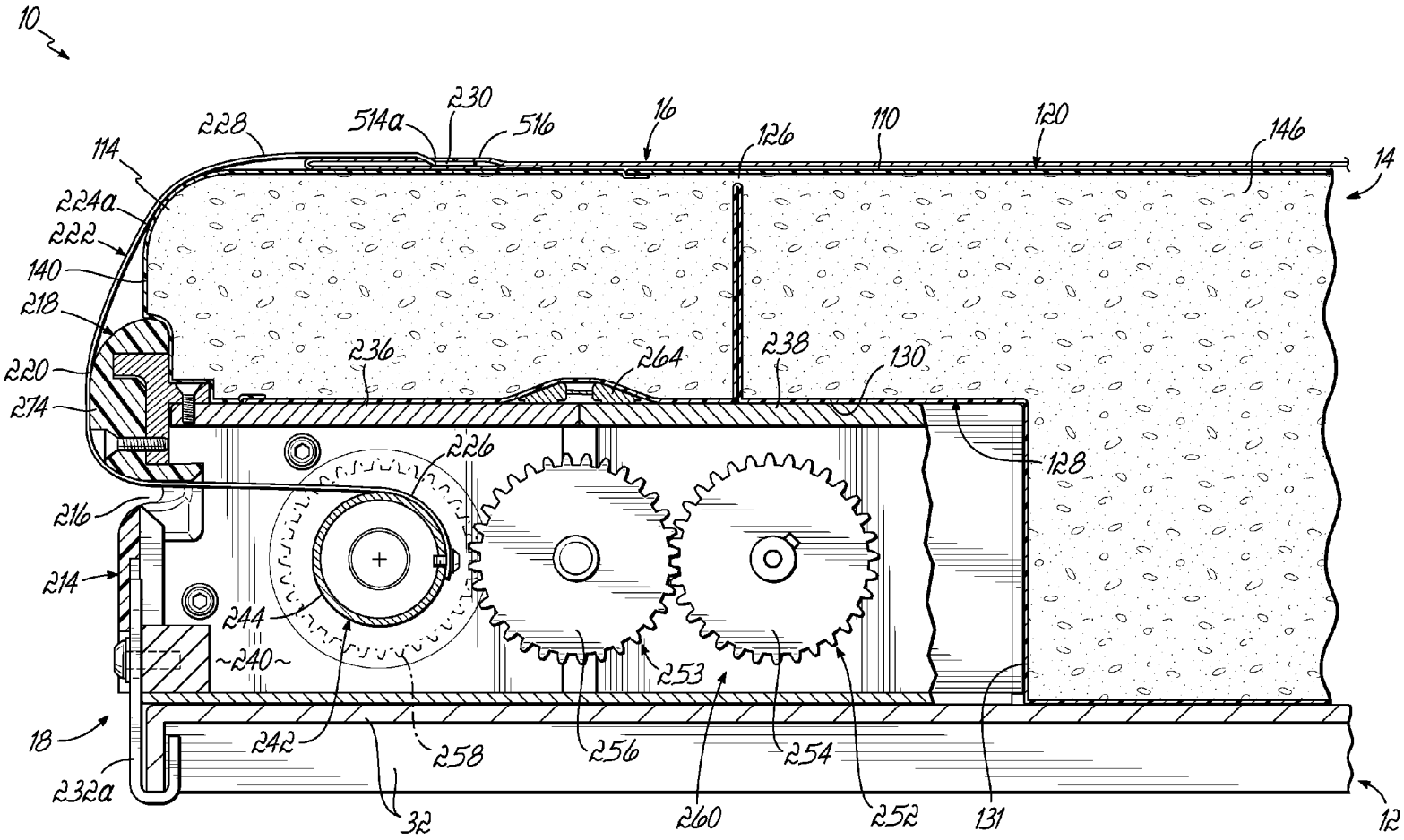
FIG. 7C is a schematic cross sectional view, similar to FIG. 7B, with the sheet attached and ready to be pulled into the housing.

As best shown in FIGS. 7A-7C and according to an exemplary embodiment of the invention, the housing 214 at least partially fits within the volume envelope 128 against the lower surface 130 and the forward surface 131 of the head end section 122. The housing 214 has a length substantially the same as the width of the mattress 14 and includes a slot 216 extending horizontally along the length of the housing 214. Additionally, the housing 214 includes an extension 218 protruding horizontally along the length of the housing 214 and above the slot 216. According to an exemplary embodiment of the invention, the extension 218 defines a lip 220 against which the head end piece 124 abuts when the sheet receiver 18 is positioned within the volume envelope 128.

Figure 3A:
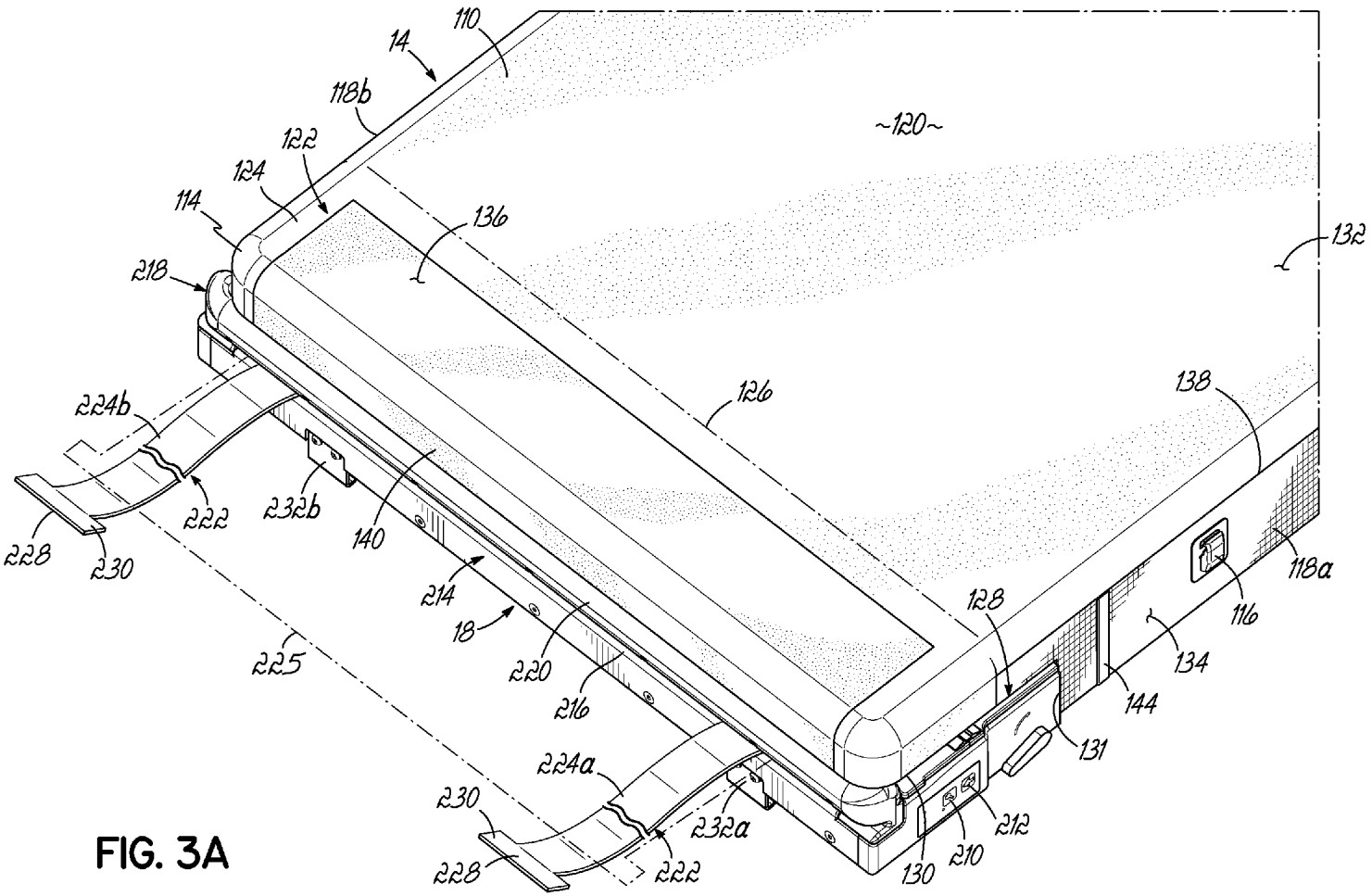
FIG. 3A is an enlarged perspective view of the mattress and the sheet receiver shown in FIG. 2, at the head end of the mattress.

FIG. 3A shows additional detail of the relative positions between the mattress 14 and the housing 214 and greater detail of the outer ticking 120. Specifically, the outer ticking 120 is formed from a comfort material 132, a durable material 134, and a stiff material 136. In this respect the comfort material 132 forms a portion of the outer ticking 120 suitable for comfortably supporting and contacting the patient, directly or indirectly. Meanwhile, the durable material 134 and the stiff material 136 form respective portions of the outer ticking 120 that increase life and durability of the mattress 14 where patient comfort is of less concern. On one hand, the durable material 134 also provides sufficient structure for attaching the retainers 116. The exemplary retainers 116 are welded to the durable material 134, but other structures and methods, such as adhesive, snaps, fasteners, or stitching, may similarly be used to attach the retainers 116 to the durable material 134. On the other hand, the stiff material 136 also provides reduced elasticity and reduced friction where components of the sheet 16 and/or sheet receiver 18 may frictionally engage the mattress 14. In this respect, the head end section 122 is relatively firmer than the rest of the mattress to support pulling the sheet 16 about the head end edge 140 as shown in FIGS. 3A-3D. While the nomenclature "comfort," "durable," and "firm" each relatively describe various features of the outer ticking 120, it will be appreciated that these features are not intended to be limited solely to these material types. Rather, the exemplary embodiment merely shows one combination of known materials for producing an outer ticking 120 with properties sufficient for use with the patient repositioning system 10.

Figure 3B:
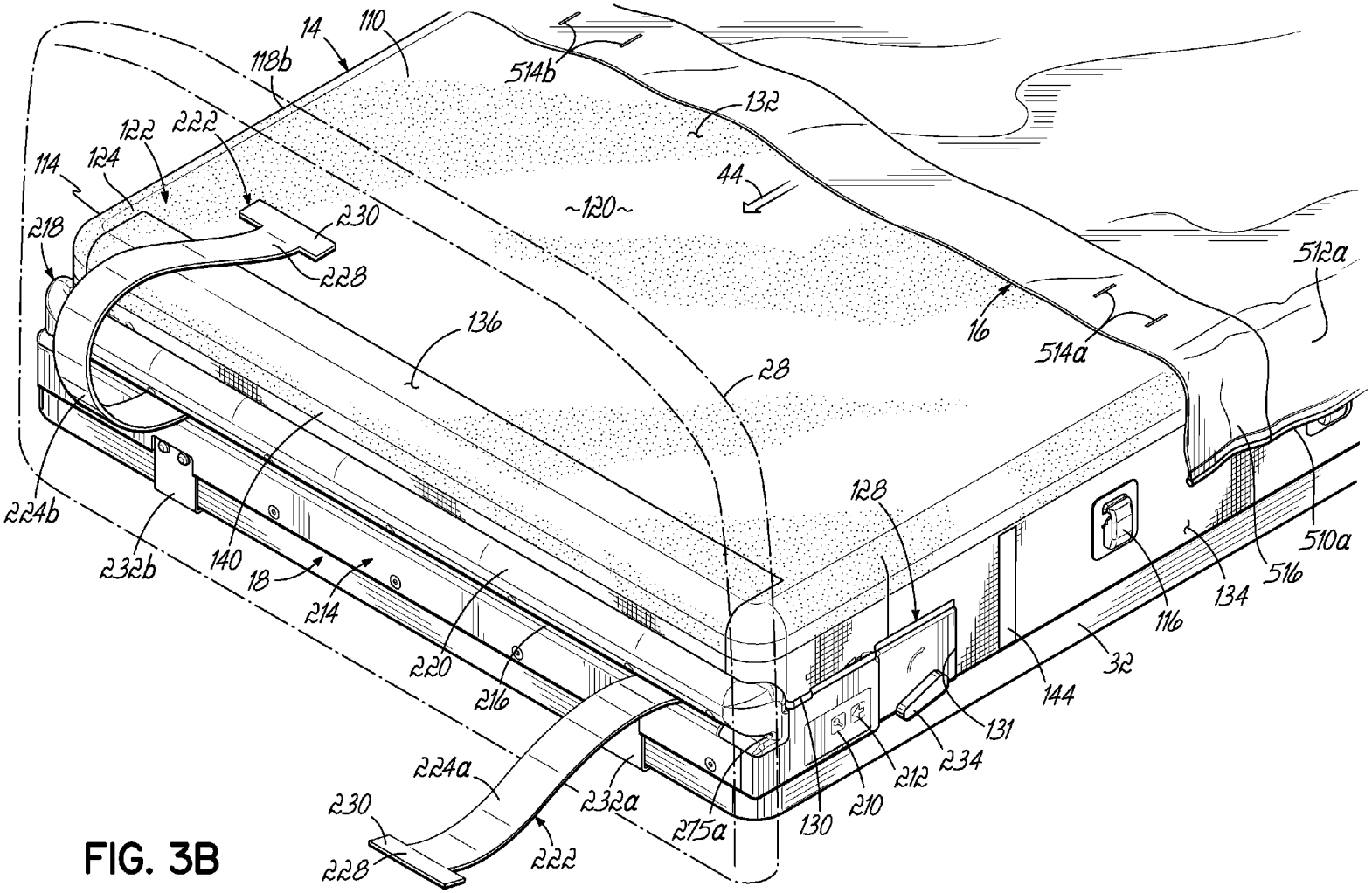
FIG. 3B is an enlarged perspective view which shows the mattress complementarily positioned against the sheet receiver, with the sheet receiver attached to the health care bed as shown in FIG. 1A, with a sheet on the mattress, and with connecting structure extending out of the sheet receiver.

With respect to FIGS. 3A and 3B, the durable material 134 is stitched to the comfort material 132 at a seam 138 extending along the mattress longitudinal sides 118*a*, 118*b*. Also, a head end edge 140 of the mattress head end 114 includes the stiff material 136 that extends along at least a portion of the head end piece 124. The stiff material 136 is attached directly onto the comfort material 132 and provides a surface of reduced elasticity about which the sheet receiver 18 may pull the sheet 16. In the alternative to stitching and/or gluing the outer ticking 120 together, the comfort, durable, and stiff materials 132, 134, 136 may be similarly welded to improve sealing and reduce the likelihood of fluids, such as bodily contaminates, from permeating into the mattress 14. However, it will be appreciated that any known method of connecting materials together to form the outer ticking 120 may be used in accordance with the invention.

Figure 3C:
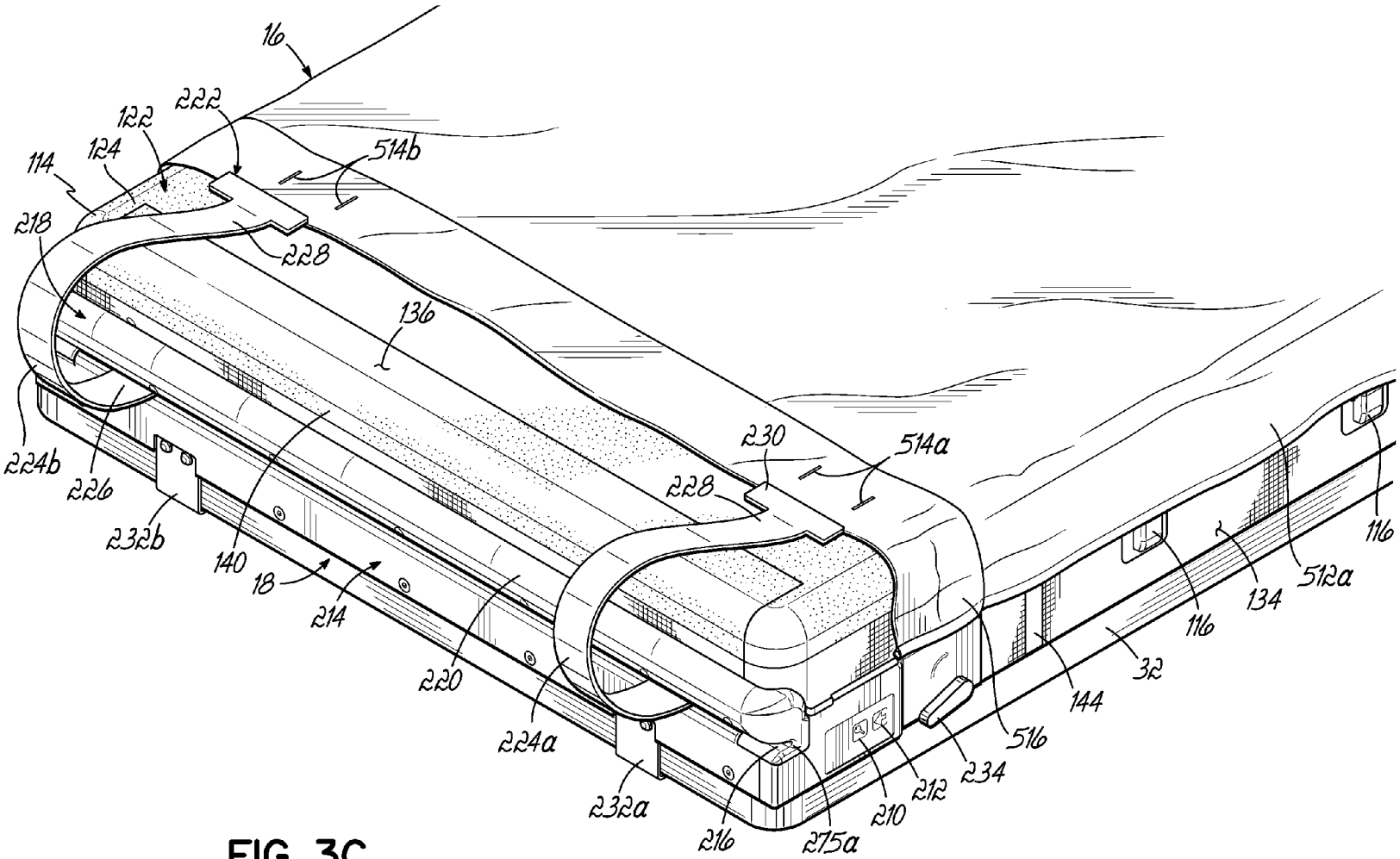
FIG. 3C is an enlarged perspective view, similar to FIG. 3B, showing the connecting structure positioned adjacent the sheet.

The sheet receiver 18 has a slot 216, and also includes a connecting structure 222 for releasably attaching to the sheet 16 adjacent to the mattress head end 114. The connecting structure 222 is generally of a sufficiently small dimension so as to pass through the slot 216 and toward the sheet 16, which may also be referred to herein as a "low-profile" connecting structure 222. According to the exemplary embodiment of the invention, the connecting structure 222 is a pair of straps 224*a*, 224*b*. Each of the straps 224*a*, 224*b* includes a first end 226 secured within the housing 214 and a second end 228 for releasably attaching to the sheet 16. Accordingly, the operator extends the pair of straps 224*a*, 224*b* about the head end edge 140 and pulls the sheet 16 along the upper surface 110 of the mattress 14, as indicated by arrow 44. The sheet head end 516 and the second end 228 each move adjacent to the mattress head end 114 as shown in FIG. 3C. Thus, in order to releasably attach the pair of straps 224*a*, 224*b*, each of the second ends 228 includes a T-shaped tab 230 that cooperates with at least one of a pair of reinforced slits 514*a*, 514*b* formed in a sheet head end 516. Notably, the width of the sheet 16 is generally wider than the upper surface 110 such that the beaded edge 510*a* rests along the mattress longitudinal side 118*a* and adjacent to the row of retainers 116. While an exemplary embodiment of the invention includes the connecting structure 222 as a pair of straps 224*a*, 224*b*, it will be appreciated that other forms of connecting structures for connecting the sheet 16 to the remainder of the sheet receiver 18 may also be used. By way of example, the connecting structure 222 may be any number of straps, such as one strap, that may be separate or unitary for pulling the sheet 16.

Figure 3D:
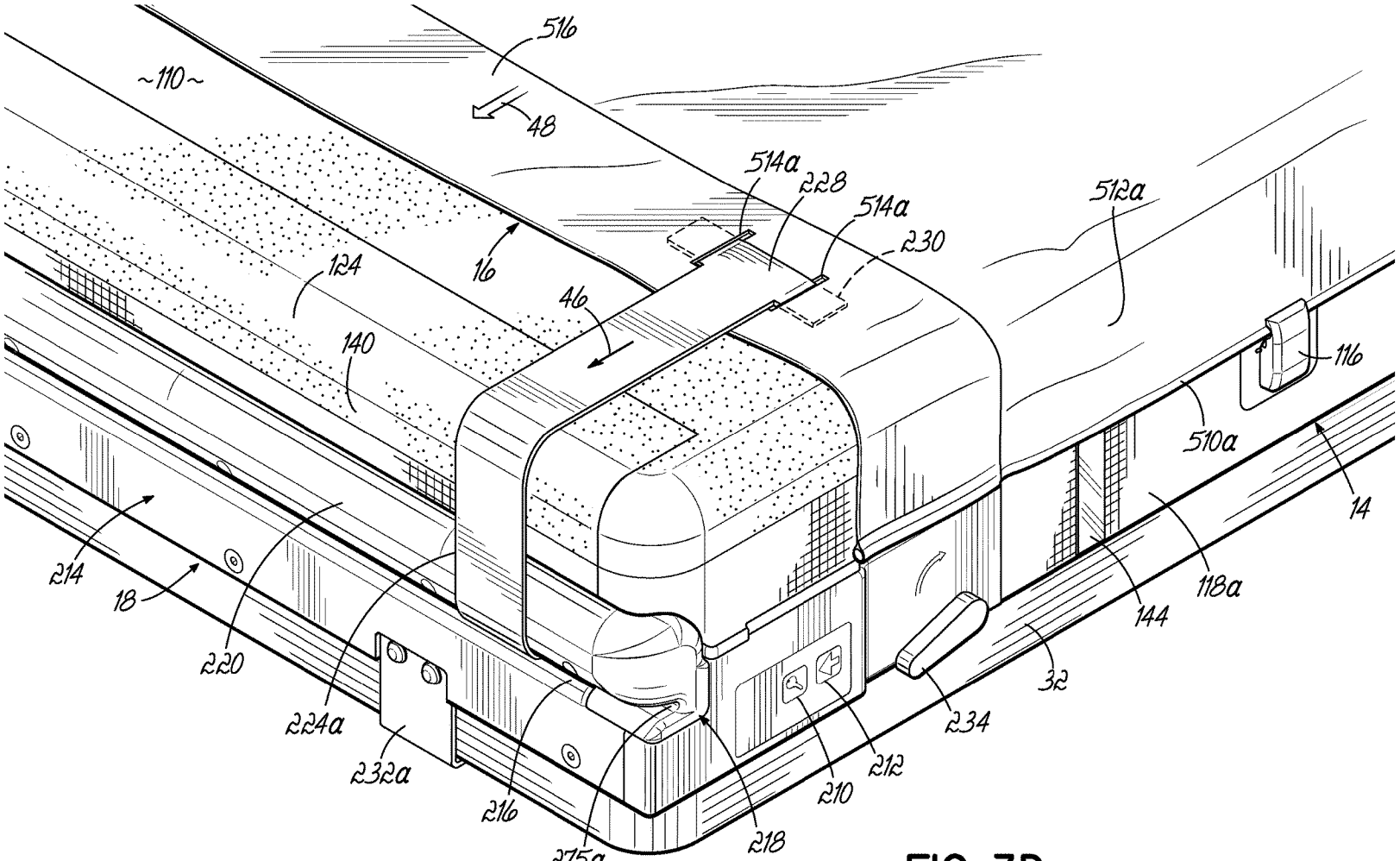
FIG. 3D is an enlarged perspective view, generally similar to FIGS. 3B and 3C, but directed to one corner of the overall system, and showing the connecting structure releasably attached to the sheet.

FIG. 3C and FIG. 3D show that each of the pair of slits 514*a*, 514*b* are spaced apart from one another and generally parallel for receiving the T-shaped tab 230. In addition, each of the retainers 116 operatively hold the beaded edge 510*a* for guiding movement of the sheet 16. More particularly, each of the straps 124*a*, 124*b* withdraw through the slot 216 and into the housing 214, as indicated by arrow 46, to simultaneously pull the sheet 16 along the upper surface 110, as indicated by arrow 48. However, in the event that an external force halts, or otherwise impedes the movement 46 of the sheet 16, the tab 230 releases from the pair of slits 514*a*, 514*b* for preventing damage to the sheet 16 and/or sheet receiver 18.

Figure 3E:
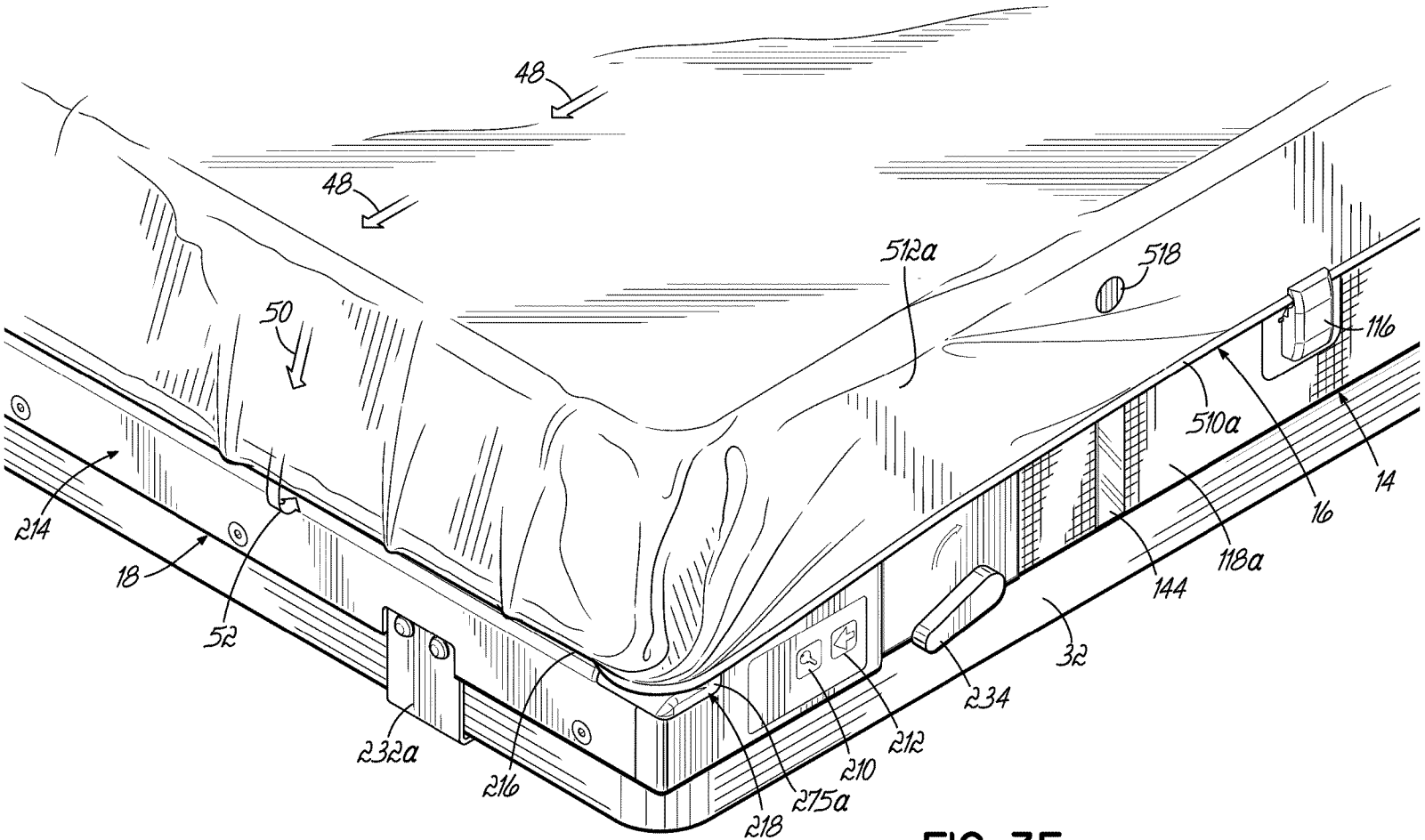
FIG. 3E is an enlarged perspective view, similar to FIG. 3D, showing the sheet as it is pulled into the sheet receiver.

As can be more clearly seen in FIG. 3D and FIG. 3E, the sheet 16 continues to move toward the mattress head end 114, about the head end edge 140, and toward the sheet receiver 18 until being pulled into the slot 216 and within the housing 214, as indicated respectively by arrows 48, 50, and 52. The sheet receiver 18 generally pulls the sheet 16 until a sufficient amount of sheet 16 collects within the housing 214 to fixedly attach the sheet 16 to the sheet receiver 18. According to an exemplary embodiment, the mattress longitudinal side 118*a* includes an alignment sheet indicia 144, and the sheet 16 includes a sheet loaded indicia 518. Once sheet loaded indicia 518 moves into alignment with the alignment sheet indicia 144, the pair of indicia 144, 518 cooperatively indicate to the operator, for instance by visual alignment, that the sheet 16 is engagingly attached to the sheet receiver 18, i.e. it is "loaded." Because the sheet 16 is engagingly attached, the sheet 16 may be used to pull both the sheet 16 and the patient (see FIG. 1B). To brace the sheet receiver 18 while pulling the patient, the sheet receiver 18 also includes a pair of mounting brackets 232*a*, 232*b* for mounting the sheet receiver directly to the head deck portion 32 below the head end section 122. However, it will be appreciated that the sheet receiver 18 may be attached to the bed via one of any number of different structures.

FIG. 3D and FIGS. 4A-5 show an exemplary embodiment of the retainer 116 having a base piece 410 and a movable piece 412. The retainer 116 secures to the mattress 14 by welding the base piece 410 directly to the durable material 134 of the outer ticking 120. In contrast, the movable piece 412 connects to the base piece 410 or otherwise projects from the base piece 410. Notably, the movable piece 412 moves relative to the base piece 410 between an open position and a closed position for defining a channel 414 therebetween. The base piece 410 is generally planar and relatively thin for providing sufficient surface area to both weld to the outer ticking 120 and connect the movable piece 412. However, the base piece 410 also includes a horizontally extending base projection 416 having a base curved portion 418 and a base planar portion 420. The movable piece 412 similarly includes a horizontally extending projection 422 having a curved portion 424 and a planar portion 426. Thus, while in the closed position, the base curved portion 418 of the base piece 410 aligns with the curved portion 424 of the movable piece 412 to define the channel 414 for retaining the beaded edge 510*a*. Also, the base planar portion 420 aligns with the planar portion 426 to define a gap 428 therebetween for allowing the remaining sheet longitudinal side 512*a* to extend toward the upper surface 110 of the mattress 14.

Figure 4A:
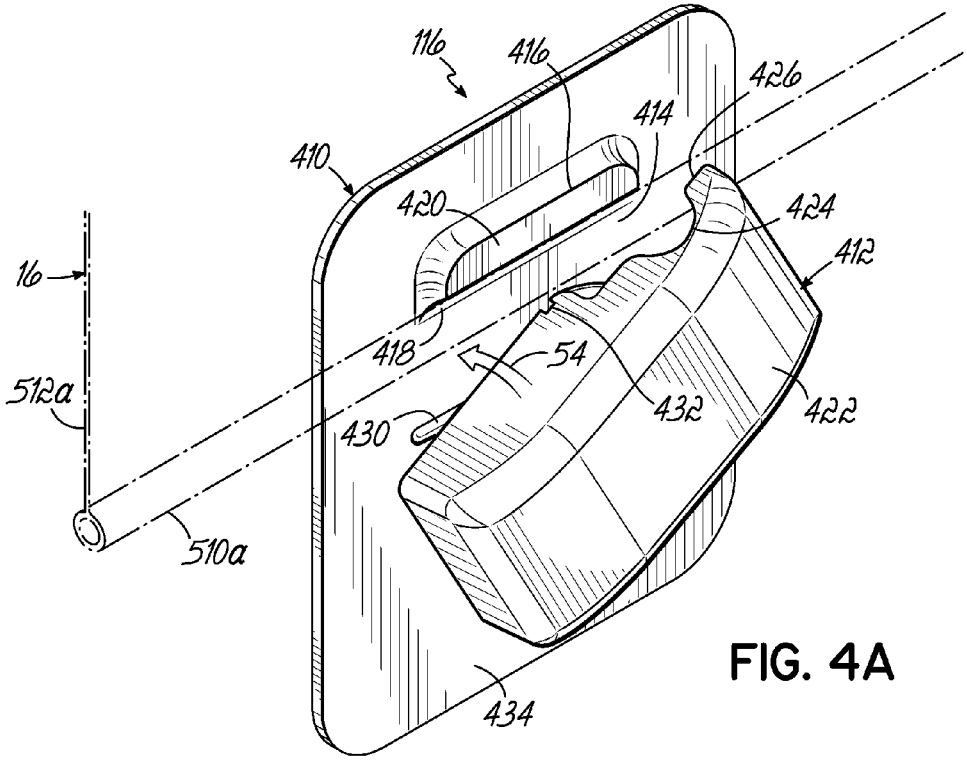
FIG. 4A is a perspective view of a retainer used for retaining a longitudinal edge of the sheet, with the retainer in an open position.
Figure 4B:
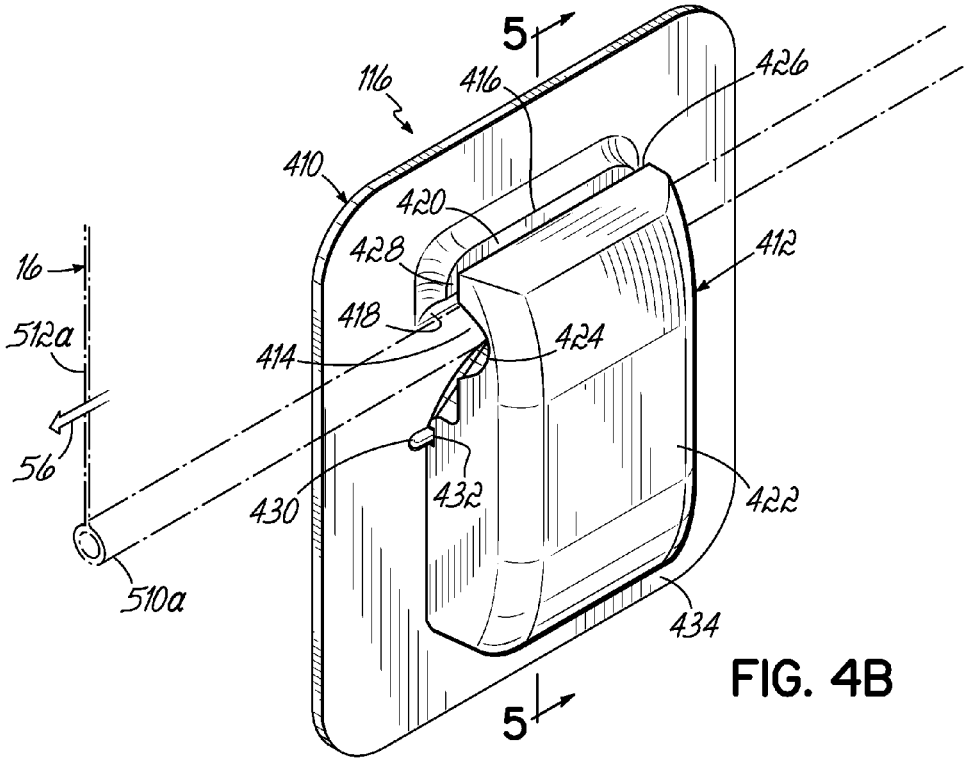
FIG. 4B is a perspective view, similar to FIG. 4A, with the retainer in a closed position.
Figure 5:
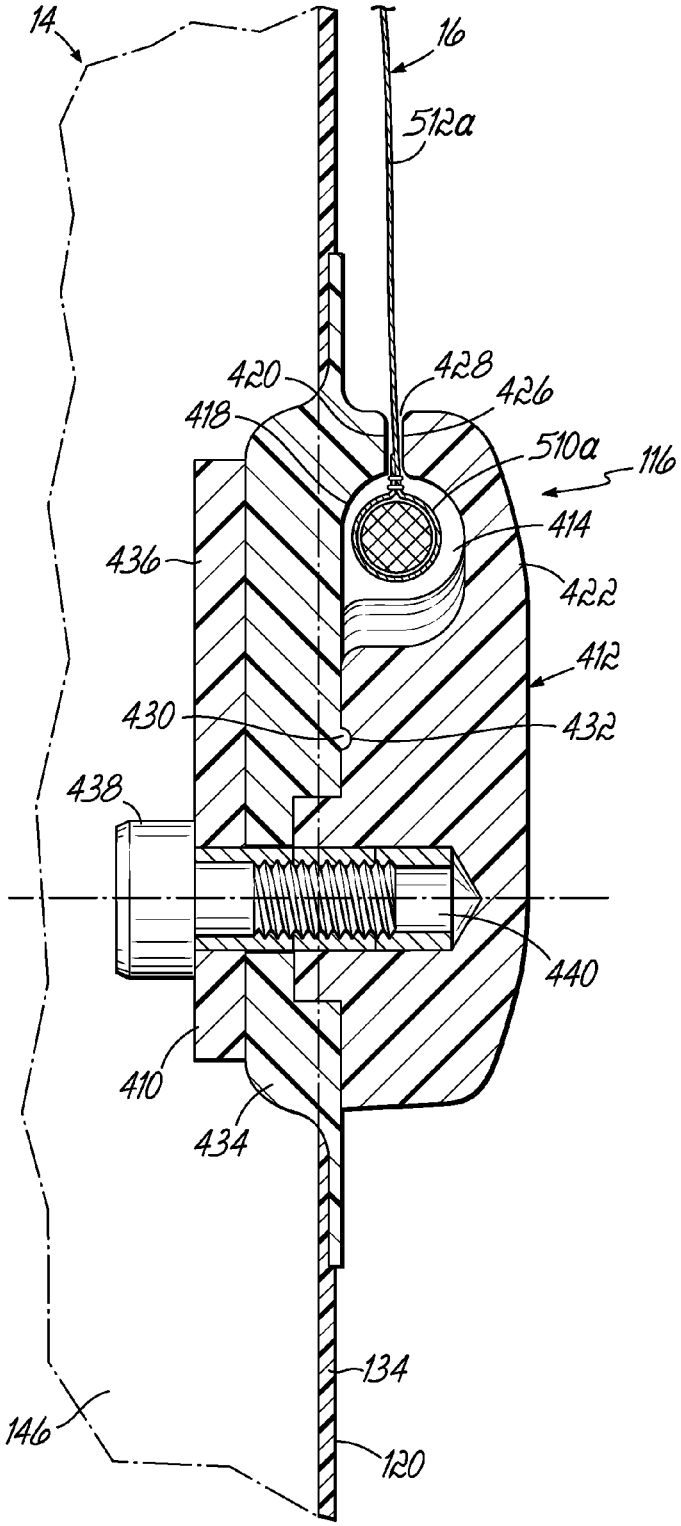
FIG. 5 is a schematic cross sectional view taken along lines 5-5 of FIG. 4B.

In the open position shown in FIG. 4A, the open channel 414 facilitates the insertion of the beaded edge 510*a* into the channel 414 and/or the removal of the beaded edge 510*a* from the channel 414. To retain the sheet 16, the movable piece 412 is rotated, or otherwise moved, as indicated by arrow 54, to the closed position. The closed position retainer 116 is shown in FIG. 4B and FIG. 5. On one hand, the closed channel 414 has a diameter generally larger than the beaded edge 510*a* for allowing the beaded edge 510*a* to slide along the channel while being pulled, as indicated by arrow 56. On the other hand, the gap 428 has a width that is generally smaller than the beaded edge 510*a* for retaining the beaded edge 510*a* within the channel 414.

Furthermore, the base and movable pieces 410, 412 each cooperate together with a detented surface relationship to affirmatively indicate when the movable piece is in the closed position. More particularly, the base piece 410 includes a horizontally extending detent 430, and the movable piece 412 includes a horizontally extending groove 432 adapted to receive the detent 430. For example, the movable piece 412 rotates against the direction of the pull 56 to open the channel 414. The movable piece 412 may then be rotated back 54 along the direction of the pull 56, as seen in FIG. 4A, to "snap" the detent 430 into the groove 432 to achieve the closed position in FIG. 4B. However, according to the exemplary embodiment, the movable piece 412 ceases to rotate 54 beyond the snap of the detent 430 and the groove 432. As such, foreseeable drag of the sheet 16 within the retainer 116 during the pull 54 will not unintentionally open the retainer 116 and release the sheet 16.

Greater detail of the rotational mounting of the movable piece 412 to the base piece 410 is shown in FIG. 5. First, the base piece 410 includes a face plate 434 for welding to the durable material 134 of the mattress 14 and abutting the movable piece 412. Second, the base piece 410 also includes a back plate 436 within a mattress foam 146 for mounting a fastener 438. A hole 440 extends through the back plate 436, the face plate 434, and into the movable piece 412. The hole 440 receives the fastener 438 for assembly of the retainer 116 and for rotatably mounting the movable piece 412 to the base piece 410. Thus, if the movable piece 412 requires any repair, the movable piece 412 may simply be removed from against the base piece 410 and a replacement movable piece 412 threaded back onto the fastener 438. However, it will be appreciated that the movable piece 412 and the base piece 410 may be movable relative to each other via a living hinge extending therebetween, or similar unitary structure.

While the exemplary embodiment of the retainer 116 is configured for retaining the sheet 16 as described above, it will be appreciated that other retainers in accordance with the invention may also be used. For exemplary purposes, additional retainers 116 for retaining the sheet 16 are described below with respect to FIGS. 13A-15E. In any case, the retainer 116 is not intended to be limited these exemplary embodiments described herein.

Figure 1C:
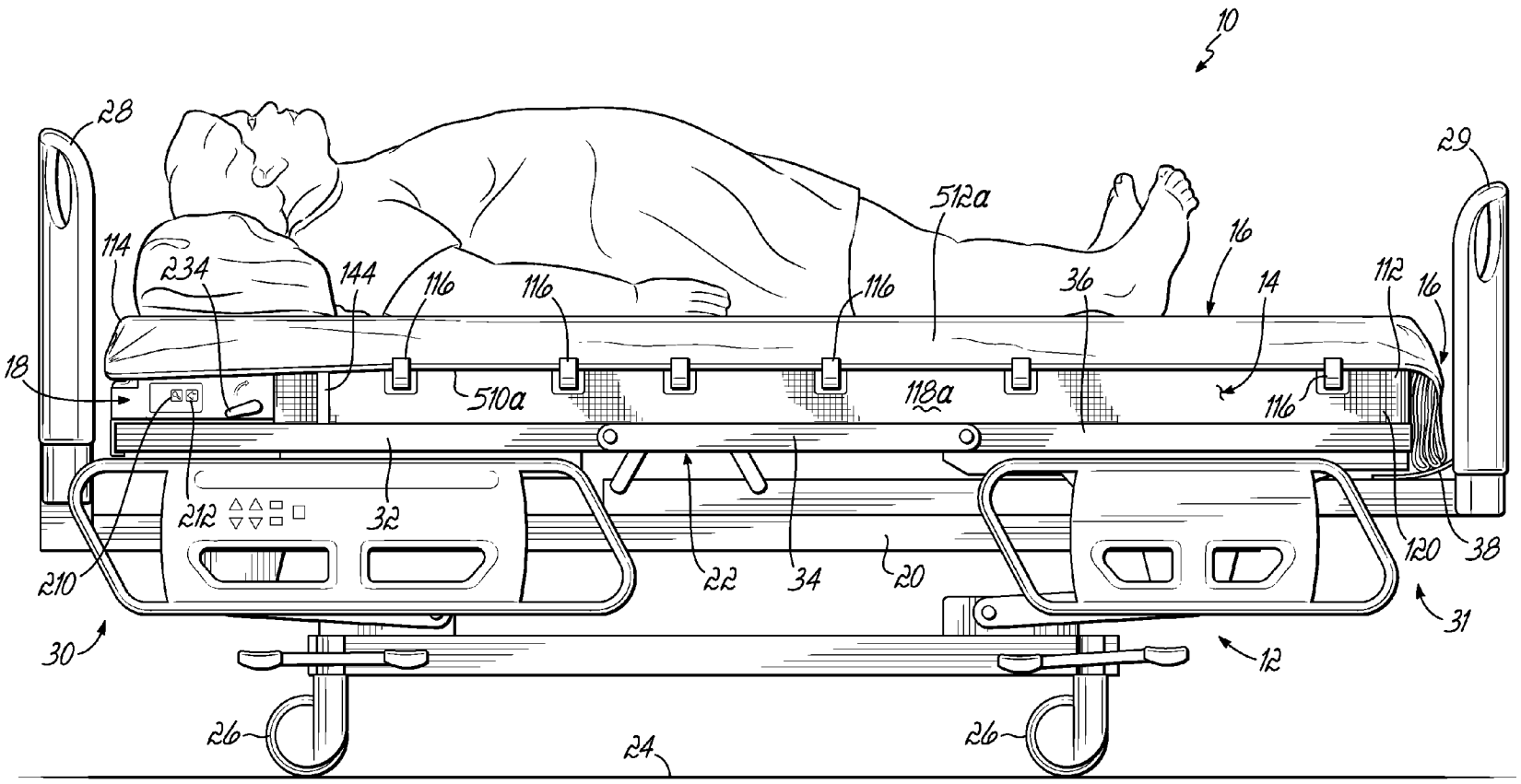
FIG. 1C is the side view similar to FIG. 1B, but with the patient residing near the head end.
Figure 6:
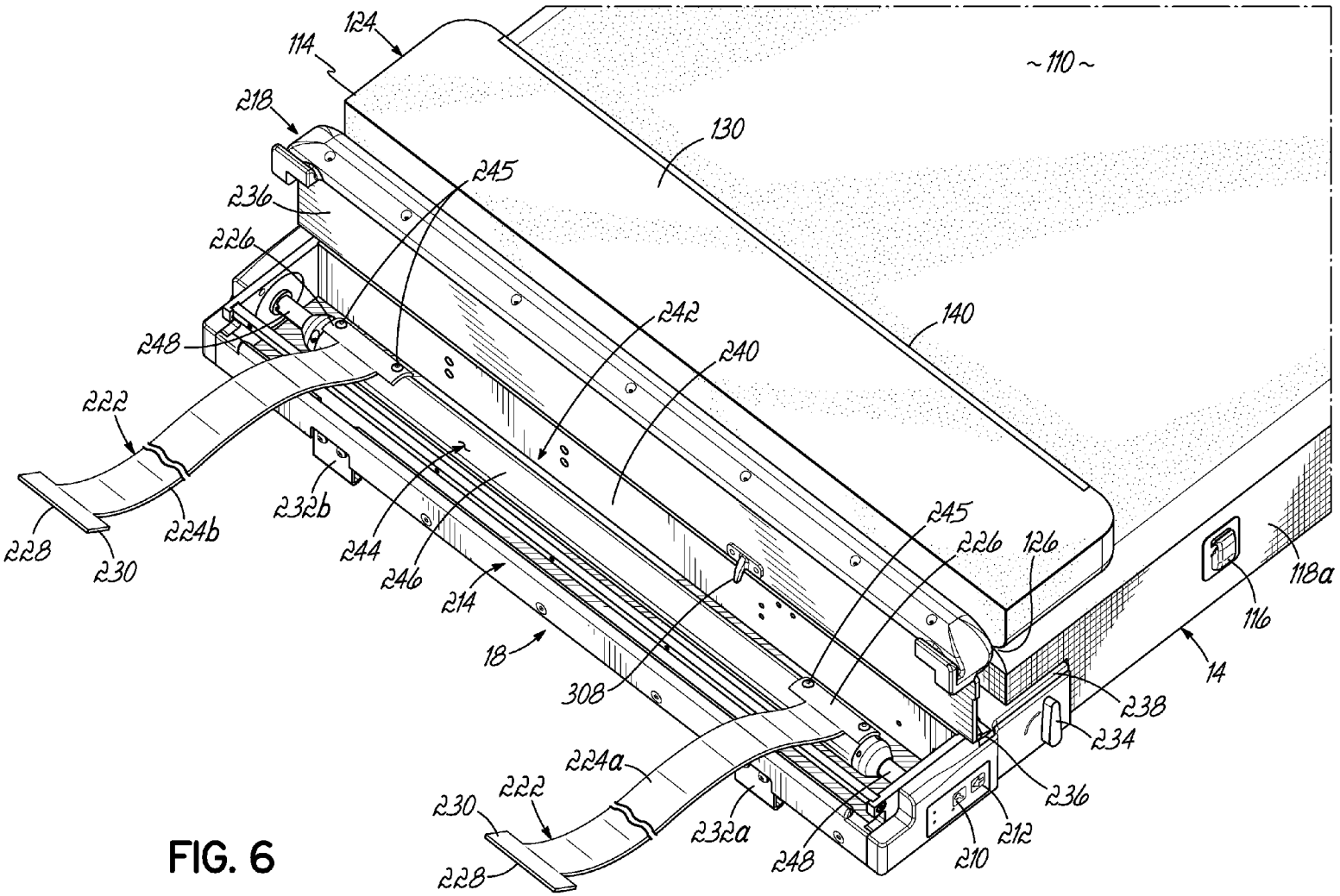
FIG. 6 is the enlarged perspective view, similar to FIGS. 3A and 3B, showing a head end piece of the mattress folded and an access door of the sheet receiver in an open position.

After the unused sheet 16 has been exhausted, the sheet 16 may be removed from the retainers 116 and sheet receiver 18 for cleaning the patient repositioning system 10 as shown in FIG. 1C and FIG. 6. Each of the retainers 116 opens at the operator's discretion for removing the sheet 16 therefrom. The sheet receiver 18 includes a sheet release 234 that may be operatively activated by the operator so that the sheet 16 may be removed from the housing 214. During patient use, the sheet 16 may become contaminated and advance into the sheet receiver 18, which, in turn, contaminates the sheet receiver 18. Thus, the sheet receiver 18 opens to provide cleaning access during and/or between patient uses as shown in FIG. 6.

With respect to FIG. 6, the housing 214 of sheet receiver 18 includes an access door 236 adjacent a top panel 238. The head end piece 124 folds back at the fold line 126 to expose the access door 236 that hingedly connects to the housing 214. As such, the operator may move the access door 236 by pivoting it up and against the mattress 14 to open the sheet receiver 18 as shown in FIG. 6. However, it will be appreciated that the access door 236 may be movable in any way relative to the remainder of the sheet receiver 18 to open the sheet receiver. For example, the access door 236 may be unitary with or connected to the head end piece 124 such that folding back the head end piece 124 simultaneously opens the access door 236. The access door 236 opens at the slot 216 for reducing the number of openings into the housing 214. The open sheet receiver 18 exposes each of the components within a sheet chamber 240 defined by the housing 214. The sheet chamber 240 includes a portion of the sheet receiver 18 that may that interact with the sheet 16 (see FIG. 1C), and thus, may require periodic cleaning by the operator. It will be appreciated that maintaining cleanliness within patient care environments, such as hospitals, nursing homes, and even private homes, critically enhances patient outcomes. For this reason, accessibility within the sheet chamber 240 provides an opportunity for the operator to simply and completely clean the sheet receiver 18 and proves particularly beneficial over the prior art described above. For example, portions of the sheet receiver 18 within the sheet chamber 240 are positioned relative to each other in order to provide enough clearance for operator cleaning and hand access for maintenance. According to an exemplary embodiment, the portions of the sheet receiver 18 within the chamber 240 provide at least generally 12 mm of clearance space therebetween.

In this respect, the sheet receiver 18 further includes a pulling device 242 operatively connected to the connecting structure 222 that operatively pulls the sheet 16 into the sheet chamber 240. More specifically, the pulling device 242 includes a roller 244 rotatably and removably supported within the sheet chamber 240 and generally parallel to the slot 216. The roller 244 includes a central portion 246 and opposing outer portions 248. Each first end 228 of the pair of straps 224*a*, 224*b* is secured to the central portion 246 of the roller 244 via at least one fastener 245. According to the exemplary embodiment of the invention, the fastener 245 is threaded and extends through the first end 228 and into the roller 244. Of course, it will be appreciated that any structure or method of securing the straps 224*a*, 224*b* to the roller 244 may be similarly used.

With respect to FIG. 1B, FIG. 3E, and FIG. 6, as the pulling device 242 pulls the sheet 16 into the sheet chamber 240, the sheet 16 is pulled to wrap about the roller 244. According to the exemplary embodiment of the invention, engaged attachment of the sheet 16 to the sheet receiver 18 occurs when the sheet 16 sufficiently wraps around the roller 244 to transmit enough torque from the roller 244 to the sheet 16 with enough force to pull the patient. More particularly, the central portion 246 is generally larger in diameter than the opposing outer portions 248. On one hand, the larger diameter of the central portion 246 transmits torque to the sheet 16 while pulling both the sheet 16 and the patient resting thereon. On the other hand, the reduced diameter of the opposing outer portions 248 accommodates the excess width of the sheet 16 for both the sheet longitudinal sides 512*a*, 512*b* and the beaded edges 510*a*, 510*b* during use. As such, most of the force required to pull the patient transmits through the portion of the sheet 16 on the upper surface 110 and about the head end section 122 of the mattress 14, while less force transmits through the sheet longitudinal sides 512*a*, 512*b*.

While the sheet 16 may be pulled by and wrapped about the roller 244 shown in FIG. 6, the sheet 16 may alternatively be pulled by other mechanisms for pulling sheets. Another exemplary embodiment may use two or more abutting rollers in the form of a roller press (not shown) for engaging and pulling a sheet. According to yet another exemplary embodiment, one or more rollers may also be placed against another type of surface for engaging and pulling the sheet. Thus, the pulling device 242 is not necessarily intended to be limited to the roller 244 wrapping the sheet 16 as described herein.

In any case, a drive mechanism 252 operatively drives the pulling device 242 for pulling the sheet 16 along the upper surface 110 of the mattress 14. FIGS. 7A and 7B show a gear drive portion 253 of the drive mechanism 252 including a drive gear 254, an idler gear 256, and a driven gear 258. The drive gear 254 is actively rotated by the remaining portion of the drive mechanism 252 described below in further detail with respect to FIG. 11. The drive gear 254 engages the idler gear 256, which, in turn, engages the driven gear 258. Thus, as the drive gear 254 actively rotates, the idler gear 256 and driven gear 258 passively rotate in response. Finally, the driven gear 258 connects to the roller 244 such that, as the driven gear 258 rotates, the roller 244 rotates in turn.

According to an exemplary embodiment of the invention shown in FIG. 3E and FIGS. 7A-7C, the driven gear 258 in conjunction with the sheet release 234 also functions as an arrestor 260 for both restricting rotation of the roller 244 and releasing the rotation of the roller 244. Restricting rotation of the roller 244 operatively holds the sheet 16 in place so as to prevent movement of the sheet 16 toward the mattress foot end 112 (see FIG. 1B), while releasing the roller 244 enables repositioning or unwrapping of the sheet 16 from the roller 244. To restrict rotation of the roller 244, the remaining portion of the drive mechanism 252 engages the drive gear 254 rigidly against the idler gear 256 when not actively rotating the driven gear 258. However, the drive gear 254 selectively moves via the sheet release 234 to disengage the idler gear 256 and release the rotation of the roller 244, as indicated by arrow 262. Thus, the driven gear 258, the idler gear 256, and the roller 244 may freely rotate, or "free-wheel," when the drive gear 254 disengages from the idler gear 256. In the alternative, the drive mechanism 252 may actively reverse under power to release the sheet 16. In another alternative, the arrestor 260 may be a brake or similar mechanism for halting the drive mechanism 252 and/or roller 244.

FIGS. 7A-7C show the access door 236 in both an open and closed position, respectively. The housing 214 further includes a hinge 264 attached between the access door 236 and the remainder of the top panel 238 for pivoting, or otherwise moving, the access door 236 between open and closed positions. The hinge 264 may also include damping or drive-assisted movement for enhanced performance between the open and closed positions.

In the closed position of FIGS. 7B-7C, the head end piece 124 of the mattress 14 conforms to both the hinge 264 and the lip 220 of the extension 218. The access door 236 opens and closes at the slot 216, which is defined by the extension 218 of the access door 236 and a front panel 272 of the housing 214. Notably, the slot 216 essentially expands into the open sheet chamber 240 when the access door 236 pivots upward toward the head end section 122 of the mattress 14 so that slot 216 and the sheet chamber 240 share a common opening. By reducing the number of openings through the housing 214 and into the sheet chamber 240, the pair of straps 224*a*, 224*b* may only extend through the housing 214 at the slot 216. In turn, the likelihood of the operator inadvertently extending the pair of straps 224*a*, 224*b* through an incorrect opening is similarly reduced while still providing ample access for the operator to clean within the sheet chamber 240.

With the access door 236 closed, the slot 216 has a transverse dimension large enough for receiving the pair of straps 224*a*, 224*b* and sheet 16, but small enough for inhibiting a human finger or other foreign object from extending therethrough. Particularly, the transverse dimension may be from about 4 millimeters to about 12 millimeters. More particularly, the transverse dimension may be less than about 8 millimeters. Furthermore, the extension 218 of the access door 236 preferably includes a "waterfall" lip 274 secured to the remaining portion of the access door 236. FIG. 7 and FIG. 3D taken together more clearly show that the waterfall lip 274 is curved for smoothly guiding the pair of straps 224*a*, 224*b* and sheet 16 into the slot 216. Similarly, the extension 218 includes a pair of contoured corners 275*a*, 275*b* further defining the slot 216 for smoothly guiding the sheet longitudinal sides 512*a*, 512*b* into the slot 216. Together, the waterfall lip 274 and contoured corners 275*a*, 275*b* reduce the likelihood of sheet stress and sheet snags while helping to maintain the sheet longitudinal sides 512*a*, 512*b* along the mattress longitudinal sides 118*a*, 118*b* by retaining the head end position of the beaded edges 510*a*, 510*b* being pulled into the slot 216, respectively. On the other hand, the waterfall lip 274 also projects outward beyond the front panel 272 for inhibiting foreign matter that lays or falls nearby from entering the slot 216 unintentionally. For example and with respect to both FIG. 1C and FIG. 7B, contaminates from the patient or tubing required for patient care may fall over the mattress head end 114 and against the sheet receiver 18 near the slot 216. However, the waterfall lip 274 decreases the likelihood of the tubing or contaminates from entering the slot 216 by directing such foreign matter outward from both the slot 216 and the front panel 272.

Furthermore, term "low-profile" with respect to the connecting structure 222 may be further defined as having the sufficiently small dimension generally less than the transverse dimension of the slot 216 for pass therethrough. Preferably, the "low-profile" connecting structure 222 has the sufficiently small dimension configured for also reducing the amount of sheet 16 deformation resulting from wrapping the sheet 16 over the connecting structure 222 on the roller 244. After all, localized deformation of the sheet 16 tends create wear patterns that may prematurely tear portions of the sheet 16. However, the "low-profile" connecting structure 222, such as the straps 224*a*, 224*b*, serves to enhance and extend the useful life of the sheet 16.

With respect to FIG. 7C, the extension 218 rigidly guides the sheet 16 and the straps 224*a*, 224*b* about the extension 218 and into the slot 216. In contrast, the head end piece 124 is relatively softer than the extension 218 for enhancing patient comfort. As such, the straps 224*a*, 224*b* and sheet 16 tend to compress the head end piece 124 while being pulled into the sheet receiver 18 and, in turn, hold the sheet 16 in excess tension. In response, once the roller 244 rotates to reposition the patient, the driven gear 258 reverses for a predetermined period time to reverse the wrapping of the sheet 16 about the roller 244. The predetermined period of time is generally long enough to release the excess tension in the sheet head end 516, but short enough to prevent the sheet 16 from becoming loosely held by the sheet receiver 16. As such, the sheet 16 remains slightly taut while allowing the head end piece 124 to return to form as shown in FIG. 7C. Alternatively, the roller 244 may operatively disengage from the drive unit, such as via a clutch 276*a* (see FIG. 8), to allow the roller 244 to freewheel for the predetermined period of time/

Figure 8:
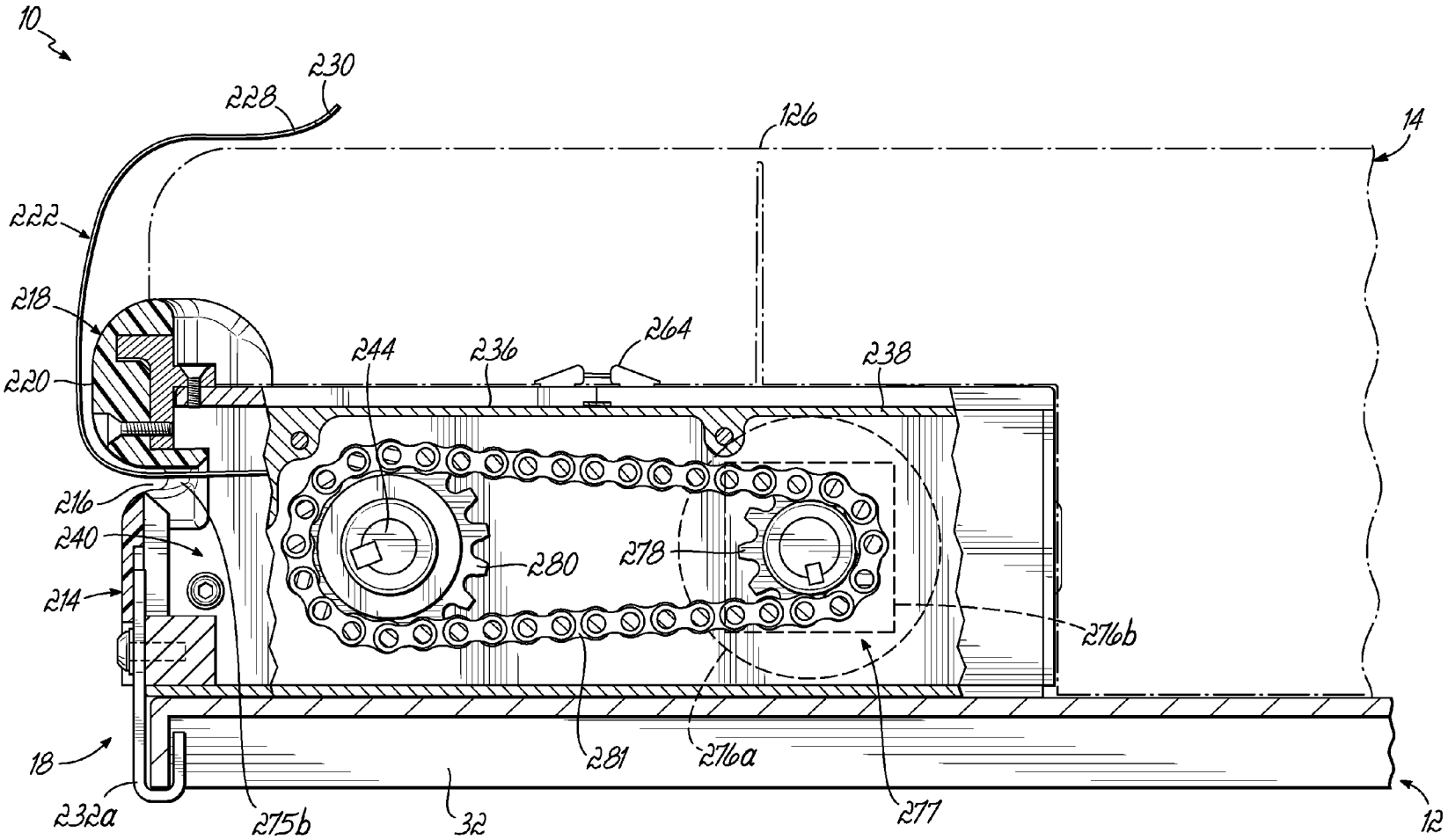
FIG. 8 is a schematic cross sectional view, similar to FIG. 7A, showing another embodiment of a portion of a suitable drive mechanism that may be used with the patient repositioning system of this invention.

FIG. 8 shows an alternative chain drive portion 277 driven by a motor 276*b* connected to a clutch 276 for rotating the roller 244 in which like numbers indicate like features described above. The chain drive portion 277 includes a chain drive gear 278 operatively connected to the clutch 276 and chain driven gear 280. Rather than pivot the chain drive gear 278 for operatively disengaging the roller 244 as described above, the clutch 276 selectively engages the chain driven gear 280. In this way, the motor 276*b* may either rotate the roller 244 or allow the roller 244 to freewheel as described above so that the clutch 276*a* acts as the arrestor 260 (see FIG. 7C). In addition, a chain 281 simultaneously wraps about the chain drive gear 278 and the chain drive gear 280 such that the actively driven chain drive gear 278 drives the chain driven gear 280 via the moving chain 281. Accordingly, the roller 244 may rotate for pulling the sheet 16 as described above. However, it will be appreciated that the other combination of drive components, such as gears, chains, sprockets, and/or belts, may be used to operatively rotate the roller 244.

Figure 9:
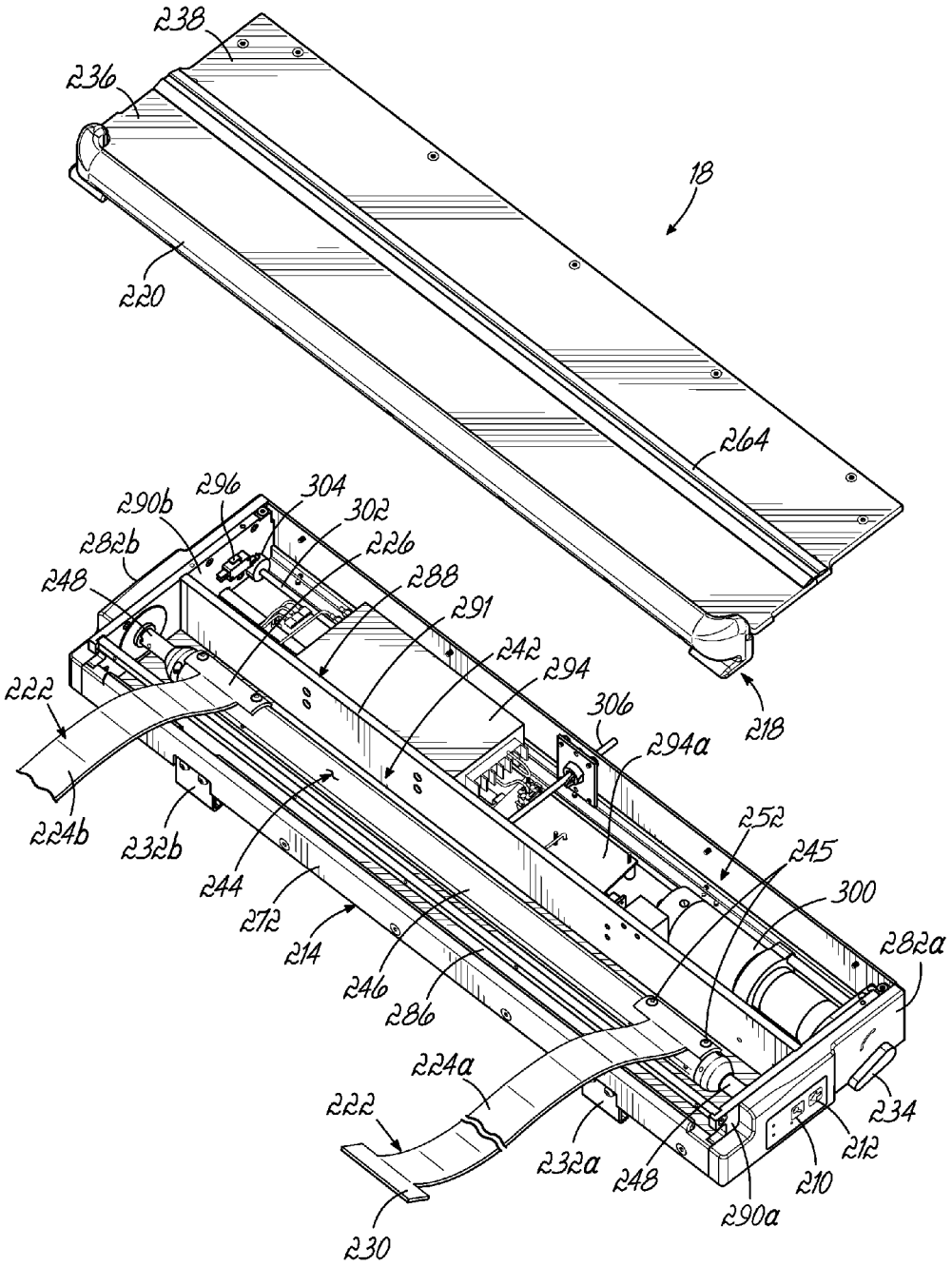
FIG. 9 is an exploded view of the sheet receiver shown in FIG. 1A.
Figure 10:
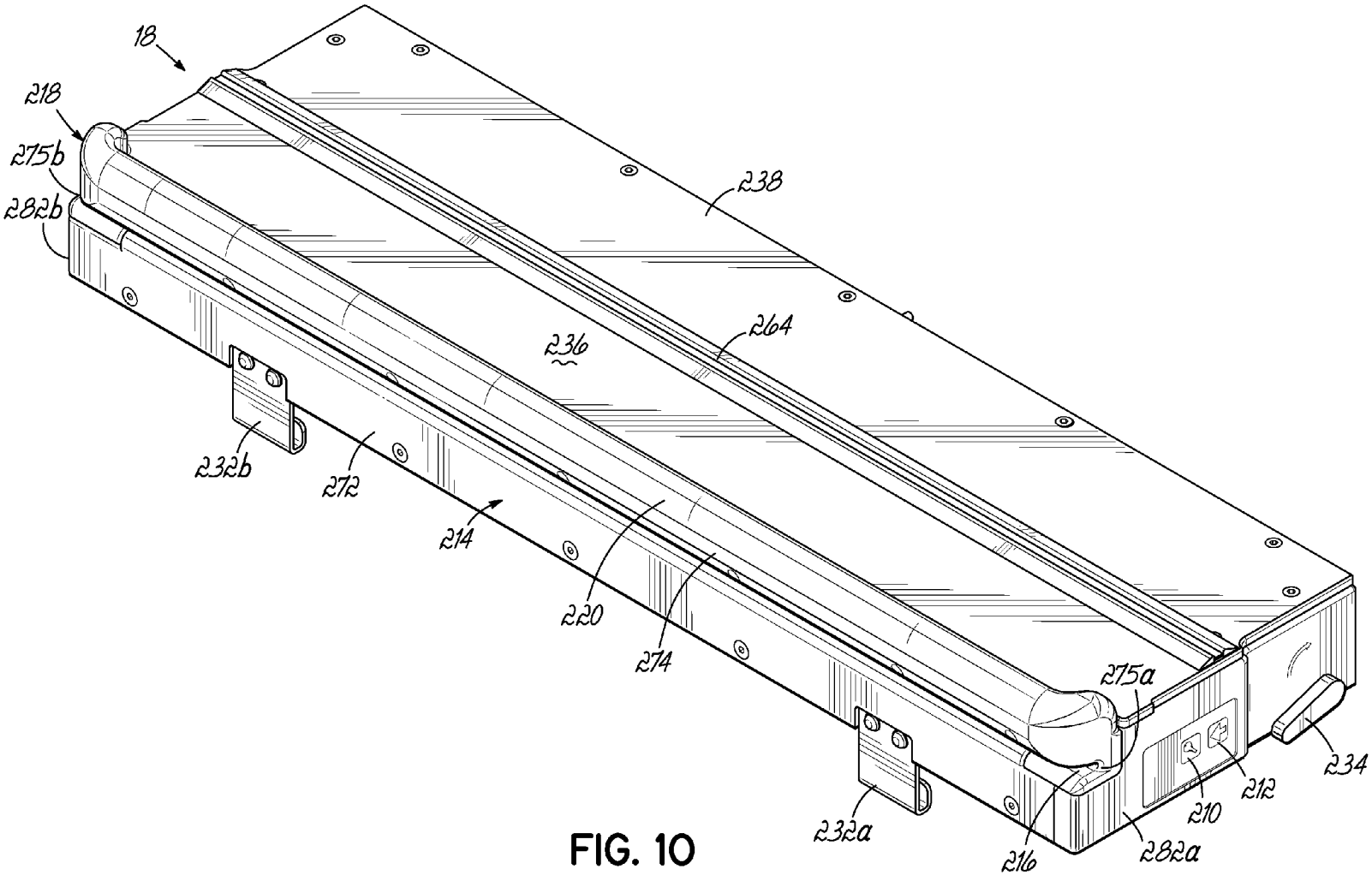
FIG. 10 is a perspective view of the sheet receiver shown in FIG. 9.
Figure 11:
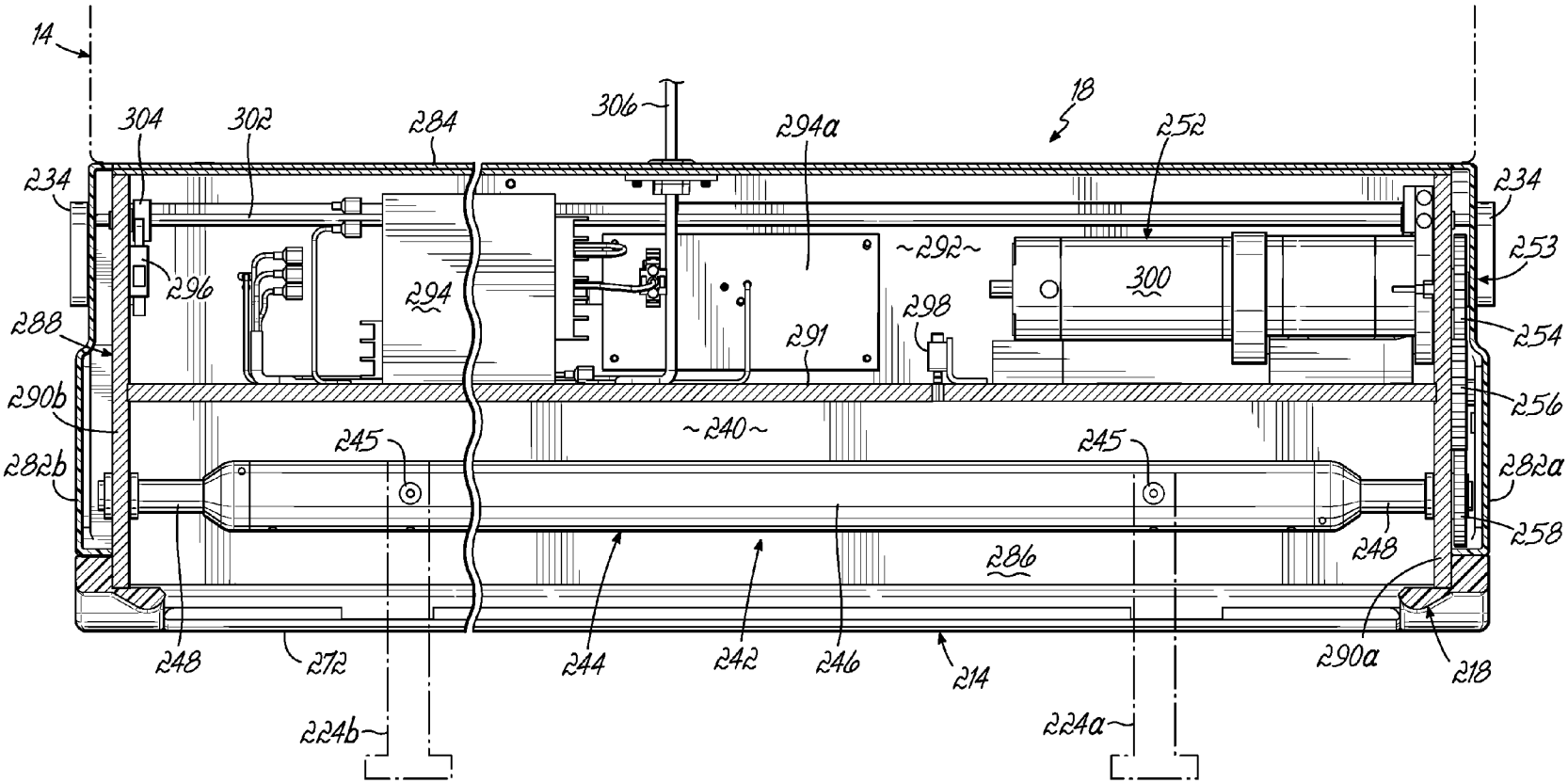
FIG. 11 is a top view of the sheet receiver that is shown in FIGS. 9 and 10, with the top panel removed.

FIGS. 9-11 show further details of the sheet receiver 18 removed from the volume envelope 128 (see FIG. 7C) of the mattress 14. The housing 214 includes the top and front panels 238, 272 described above and also a pair of side panels 282*a*, 282*b*, a rear panel 284, and a bottom panel 286. Furthermore, the housing 214 has a housing frame 288 that includes a pair of lateral support members 290*a*, 290*b* and a central cross member 291. The central cross member 291 extends perpendicularly between the pair of lateral support member 290*a*, 290*b* and divides space within the housing 214 into the sheet chamber 240 and a drive chamber 292. The members 290*a*, 290*b*, 291, 290*a*, 290*b* may also be rounded to facilitate cleaning within the sheet chamber 292. More particularly, the sheet chamber 240 is defined by the top panel 236, the support members 290*a*, 290*b*, the bottom panel 286, and the front panel 272. Also, the drive chamber 292 is defined by the top panel 238, the support members 290*a*, 290*b*, the bottom panel 286, and the rear panel 284.

The drive chamber 292 generally includes the remaining portion of the drive mechanism 252. According to the exemplary embodiment, the drive mechanism 252 also includes a power source 294, a controller 294*a*, a sheet release sensor 296, a door sensor 298, and a motor 300. The motor 300 directly connects to the drive gear 254 for selectively rotating the drive gear 254. In addition, the pair of lateral support members 290*a*, 290*b* rotatably supports a sheet release rod 302 within the drive chamber 292. The motor 300 connects to the rotatable sheet release rod 302, which extends through the side panels 282*a*, 282*b* to each of the sheet releases 234. At the operator's discretion, movement of the sheet release 234 pivots the motor 300 about the sheet release rod 302. In turn, the drive gear 254 directly connected to the motor 300 pivots, as indicated by arrow 262 in FIG. 7A, for operating the sheet release 234.

With respect to FIG. 11 and FIG. 1B, the controller 294*a* electrically connects to the motor 300, the sheet release sensor 296, the door sensor 298, the enabling switch 210, and the drive switch 212 for operating the sheet receiver 18. The controller 294*a* also connects to a power source 294 via a power cord 306 for powering the drive mechanism 252. As described above, the enabling switch 210 and drive switch 212 cooperate for directing the controller 294*a* to power the motor 300, rotate the drive gear 254, and effectively pull the sheet 16. However, the sheet release sensor 296 and door sensor 298 are configured for preventing powering the motor 300 for movement while either sheet release 234 is active or the access door 236 is open, respectively. For example, rotating the sheet release rod 302 via the sheet release 234 moves a sheet release cam 304 that operatively engages the sheet release sensor 296. The engaged sheet release sensor 296 then operatively prevents the controller 294*a* from operating the motor 300. Similarly, the door sensor 298 is configured to selectively engage a door projection 308 attached to the access door 236 (see FIG. 6). On one hand, when the access door 236 closes, the door projection 308 engages the door sensor 298 for indicating the closed access door 236 to the controller 294*a*. On the other hand, when the access door 236 opens, the door projection 308 (see FIG. 6) disengages from the door sensor 298 for indicating the open access door 236 to the controller 294*a*. Accordingly, the controller 294*a* recognizes this engagement or disengagement with the door sensor 298 and only permits the motor 300 to operate when the access door is closed. The controller 294*a* may also monitor the rotation of the roller 244 by directly counting revolutions of the roller 244 or indirectly counting revolutions of the roller 244 by timing the amount that the motor 300 advanced the roller 244. In either case, the controller 294*a* correlates the number of roller 244 revolutions to the length of sheet 16 wrapped about the roller 244. Finally, the controller 294*a* may indicate the status of the sheet 16 to the operator as described below.

According to the exemplary embodiment of the invention, the drive mechanism 252 is contained entirely within the housing 214 of the sheet receiver 18. However, in the alternative, portions of the drive mechanism 252 may be exterior of the housing 214. The portions of the drive mechanism 252 may be similar portions of the pulling device 242 that connect, directly or indirectly, to the portions of the drive mechanisms 252 for rotating the roller 244. An exemplary embodiment of a portion of the drive mechanism 252 exterior of the housing 214 will be described below in further detail.

Figure 12:
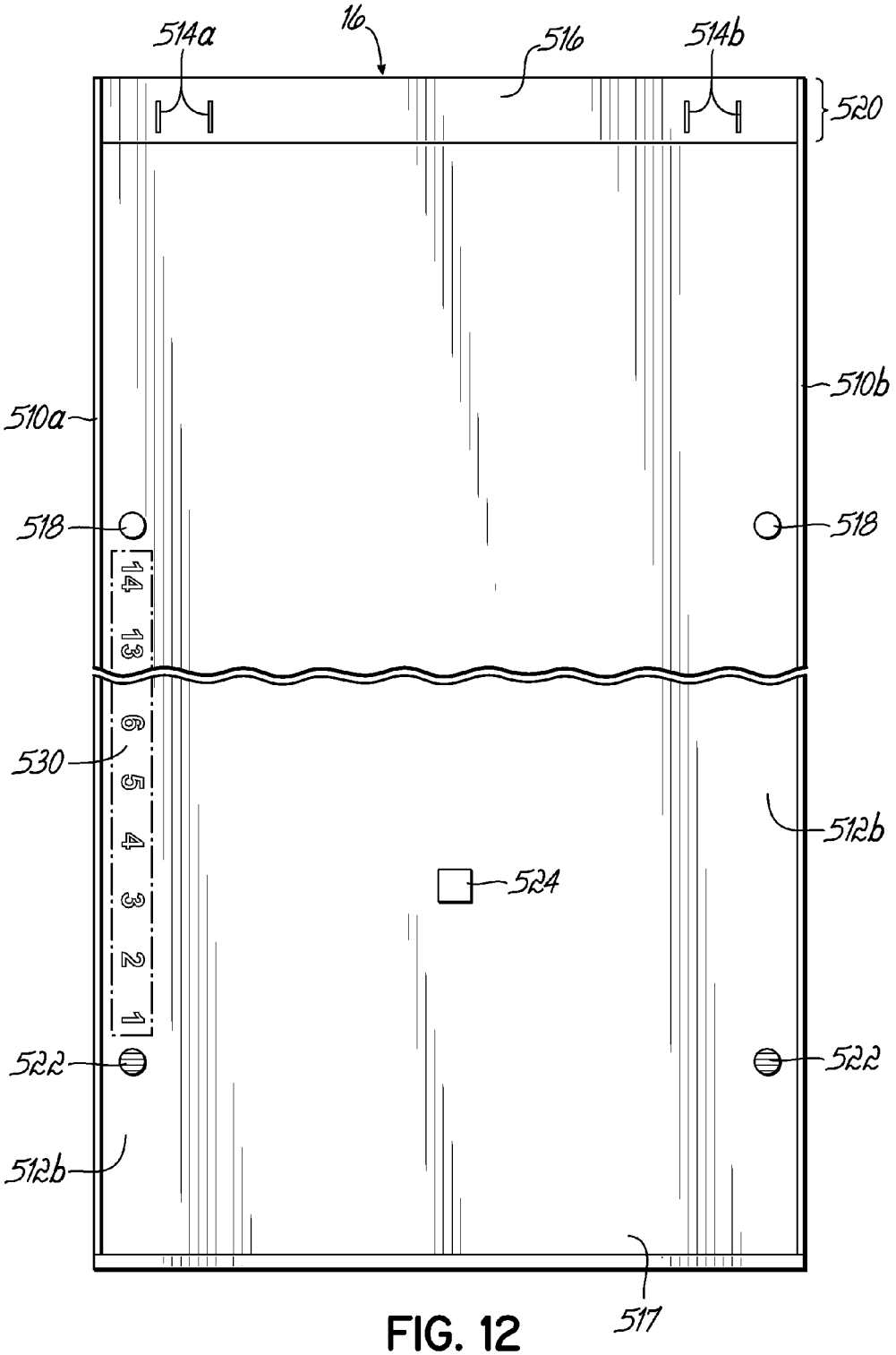
FIG. 12 is a top view of a sheet according to the embodiment shown in FIG. 1A.

FIG. 12 shows an exemplary embodiment of the sheet 16 for use with the sheet receiver 18 of FIG. 11. The sheet 16 includes the sheet head end 516 and an opposing sheet foot end 520. Furthermore, the sheet longitudinal sides 512*a*, 512*b* and beaded edges 510*a*, 510*b* extend from the sheet head end 516 to the sheet foot end 520. The sheet head end 516 also preferably includes a reinforced sheet portion 521 into which the slits 514*a*, 514*b* are sown. Examples of reinforced sheet portions 520 may comprise of multiple layers of material and/or additional stitching. Additionally, the sheet 16 may includes a reinforced sheet portion 521 and slits 514*a*, 514*b* at both the head and foot ends 516, 520 of the sheet 16. As such, the sheet 16 is generally symmetrical and may be operatively connected to the sheet receiver 18 at either the sheet head end 516 or the sheet foot end 520.

Figure 13A:
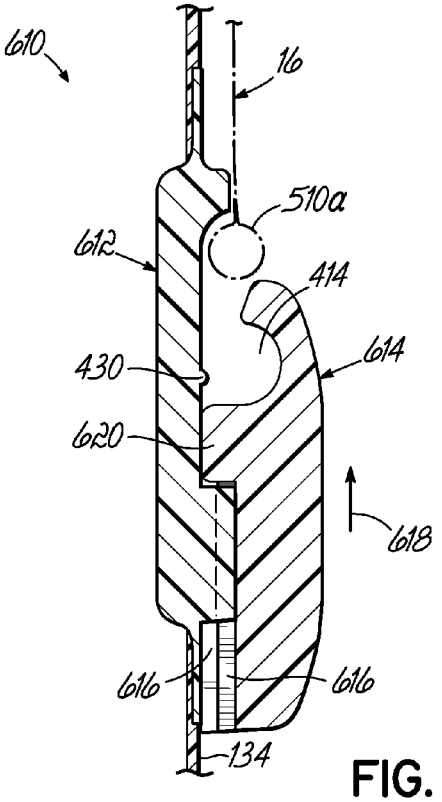
FIG. 13A is a schematic cross sectional view of an alternative embodiment of the retainer, namely a slide retainer in an open position.
Figure 13B:
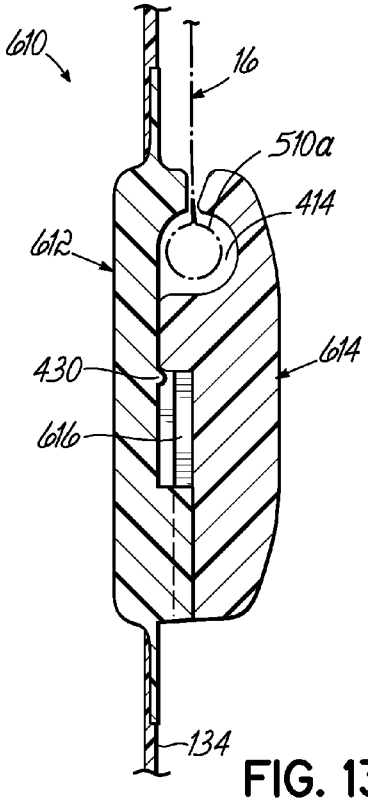
FIG. 13B is a schematic cross sectional view of the slide retainer shown in FIG. 13A, in a closed position.

The sheet 16 also includes the sheet loaded indicia 518 and a sheet usage indicia 522. In contrast to the sheet loaded indicia 518 described above, the sheet usage indicia 522 aligned with the alignment sheet indicia 144 of the mattress 14 (see FIG. 3A) indicates to the operator that a sufficient length of the sheet 16 is within the sheet receiver 18 and, thus, should be replaced with another sheet 16. According to the exemplary embodiment, the sheet loaded indicia 518 is a green circle, and the sheet usage indicia 522 is a red octagon, similar to a traditional traffic "stop sign." The sheet 16 may also include a sheet remaining indicia (not shown)

or a coded section 524. The sheet remaining indicia may be positioned along the length of the sheet 16 and indicate to the operator the length of the sheet remaining before reaching the sheet usage indicia 522. The coded section 524 may communicate with the sheet receiver 18 for verifying any information related to the sheet 16 and/or indicating such information to the operator. For example, the coded section 524 may communicate to the sheet receiver 18 the type of sheet, engaged attachment, length of sheet remaining, or any other relevant status information concerning the sheet 16 to the operator. The sheet 16 may also includes a measured indicia 530 for communicating to the operator the amount of sheet 16 used, remaining, or the number of pulls remaining with respect to the present position of the sheet 16. An exemplary embodiment of the measured indicia 530 indicates the number of pulls remaining via numerical indicators; however, it will be appreciated that any visual indication may be used in accordance with the invention. FIG. 13A-15B show alternative embodiments of retainers according to the invention. In this respect, like numbers indicate like features of the retainers. FIG. 13A and FIG. 13B show a slide retainer 610 including a base piece 612 and a movable piece 614. The movable piece 614 connects to the base piece 612 or otherwise projects from the base piece 612. In addition, the movable piece 614 moves relative to the base piece 612 between the open position and the closed position for defining the channel 414 and retaining the sheet 16, as described above.

More particularly, the base piece 612 and movable piece 614 each include cooperating tracks 616. The track 616 of the movable piece 614 slides into the track 616 of the base piece 612 for connecting the base piece 612 and the movable piece 614 together. In addition, the movable piece slides along the track 616 of the base piece 614 to open and close the channel 414, as indicated by arrow 618. Because the movable piece 614 slides against the base piece 612, a stopper 620 protrudes from the movable piece 614 toward the base piece 612 to engage the detent 430 and inhibit movement of the movable piece. Of course, the operator may simply snap the stopper 620 beyond the detent 430 in either direction such that the detent 430 is received in either the track 616 of the movable piece 614 or the closed channel 414. However it will be appreciated that any base piece 612 and movable piece 614 slidably attached may open and close the channel 414 as described above. Accordingly, the slide retainer 610 is not intended to be limited to the exemplary embodiment described herein.

Figure 14A:
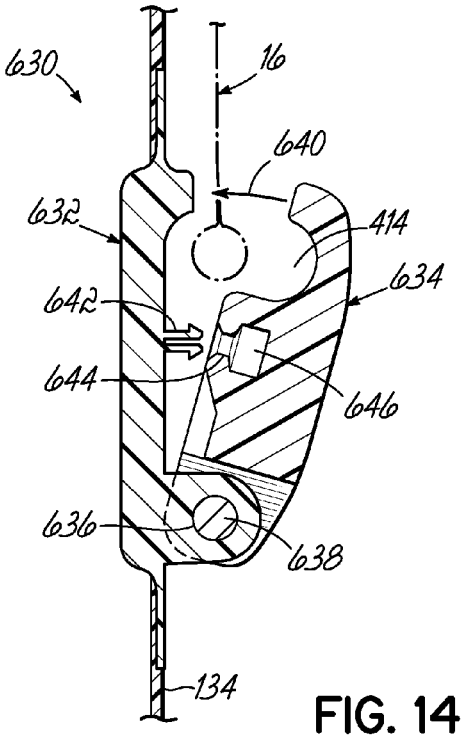
FIG. 14A is a schematic cross sectional view of yet another embodiment of a retainer, namely a pivot retainer, in an open position.
Figure 14B:
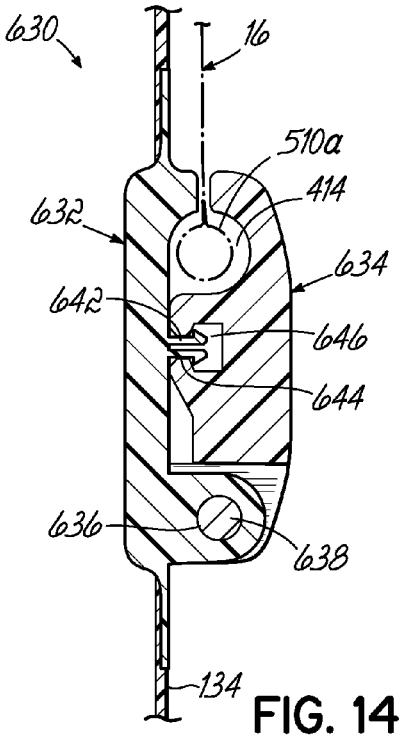
FIG. 14B is a schematic cross sectional view of the pivot retainer shown in FIG. 14A, in a closed position.

FIG. 14A and FIG. 14B show a pivot retainer 630 including a base piece 632 and a movable piece 634. The movable piece 634 connects to the base piece 632 or otherwise projects from the base piece 632. In addition, the movable piece 634 moves relative to the base piece 632 between the open position and the closed position for defining the channel 414 and retaining the sheet 16, as described above.

More particularly, the base piece 632 and movable piece 634 include a pair of holes 636 and a pair of dowels 638 respectively. The holes of the base piece 632 receive the dowels 638 of the movable piece 634 such that the movable piece 634 pivots between open and closed positions, as indicated by arrow 640. In addition, the base piece 632 includes a tab portion 642 that extends toward a collar 644 defined by an opening 646 in the movable piece 634. As the movable piece 634 pivots to the closed position, the tab portion 642 snaps against the collar 644 for holding the movable piece closed. Thereby, the operator may simply snap the tab portion 642 into the opening 646 and out of the opening 646 to respectively open or close the channel 414. However it will be appreciated that any base piece 632 and movable piece 634 pivotably attached may open and close the channel 414 as described above. Accordingly, the pivot retainer 630 is not intended to be limited to the exemplary embodiment described herein.

Figure 15A:
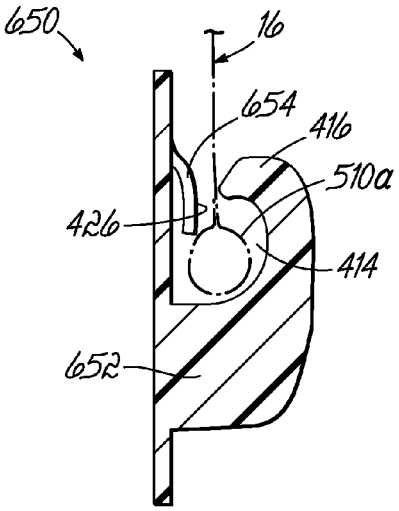
FIGS. 15A and 15B are schematic cross sectional views of still another embodiment of a retainer, in this case a clip retainer.
Figure 15B:
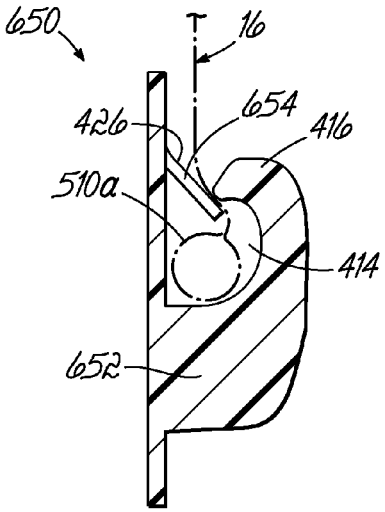

FIG. 15A and FIG. 15B show a clip retainer 650 including a base piece 652 and a movable piece 654. The movable piece 654 connects to the base piece 652 or otherwise projects from the base piece 410. In addition, the movable piece 654 moves relative to the base piece 652 between the open position and the closed position for defining the channel 414 and retaining the sheet 16, as described above. More particularly, the base piece 652 is generally rigid and includes the lip projection 416. The movable piece 654 is generally flexible and resiliently extends from the base piece 652 against the lip projection 416. The movable piece 654 also includes the planar portion 426 resiliently held against the lip projection 416 to define the channel 414 of the clip retainer 650 in the closed position. However, the movable piece 654 may resiliently bend toward the open channel 414 to receive the sheet 16, but resiliently bends back to again close the channel 414. As such, the operator may simply snap the beaded edge 510*a* of the sheet 16 into the channel 414. However it will be appreciated that any base piece 652 and movable piece 654 may resiliently bend to open and close the channel 414 as described above. Accordingly, the clip retainer 650 is not intended to be limited to the exemplary embodiment described herein.

Figure 16A:
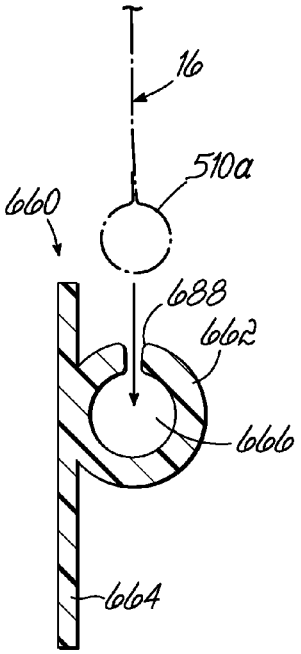
FIGS. 16A, 16B, and 16C are schematic cross sectional views of yet another embodiment of a retainer, in this case a rigid retainer which retains a compressible bead located at the edge of a sheet.
Figure 16B:
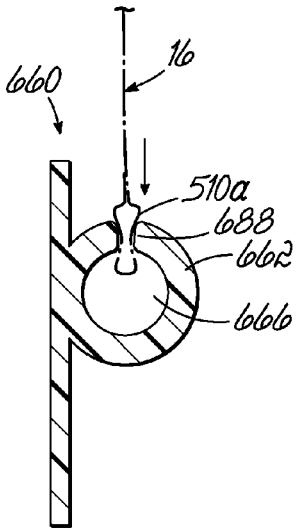
Figure 16C:
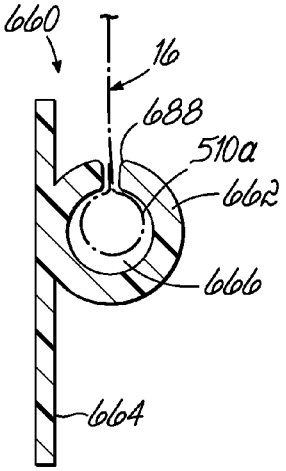

FIGS. 16A-16C show a rigid retainer 660 having a body portion 662 and a base portion 664. The base portion 664 is generally planar and configured for attaching or welding as described herein. The body portion 662 defines a channel 666 and includes an opening 668 that extends through the body portion 662 and into the channel 666. Generally, the sheet 16 includes the beaded edge 510*a*, which is received within the channel 666. However, the beaded edge 510*a*, according to an exemplary embodiment, is generally compressible for insertion through the opening 668 and into the channel 666. In addition, the opening 668 may be tapered such that the opening 668 narrows into the channel 666. Accordingly, the beaded edge 510 and the opening 668 mate such that the insertion force needed to position the beaded edge 510*a* into the channel 666 is less than the removal force needed to withdraw the beaded edge 510*a* from the channel 666.

Figure 17:
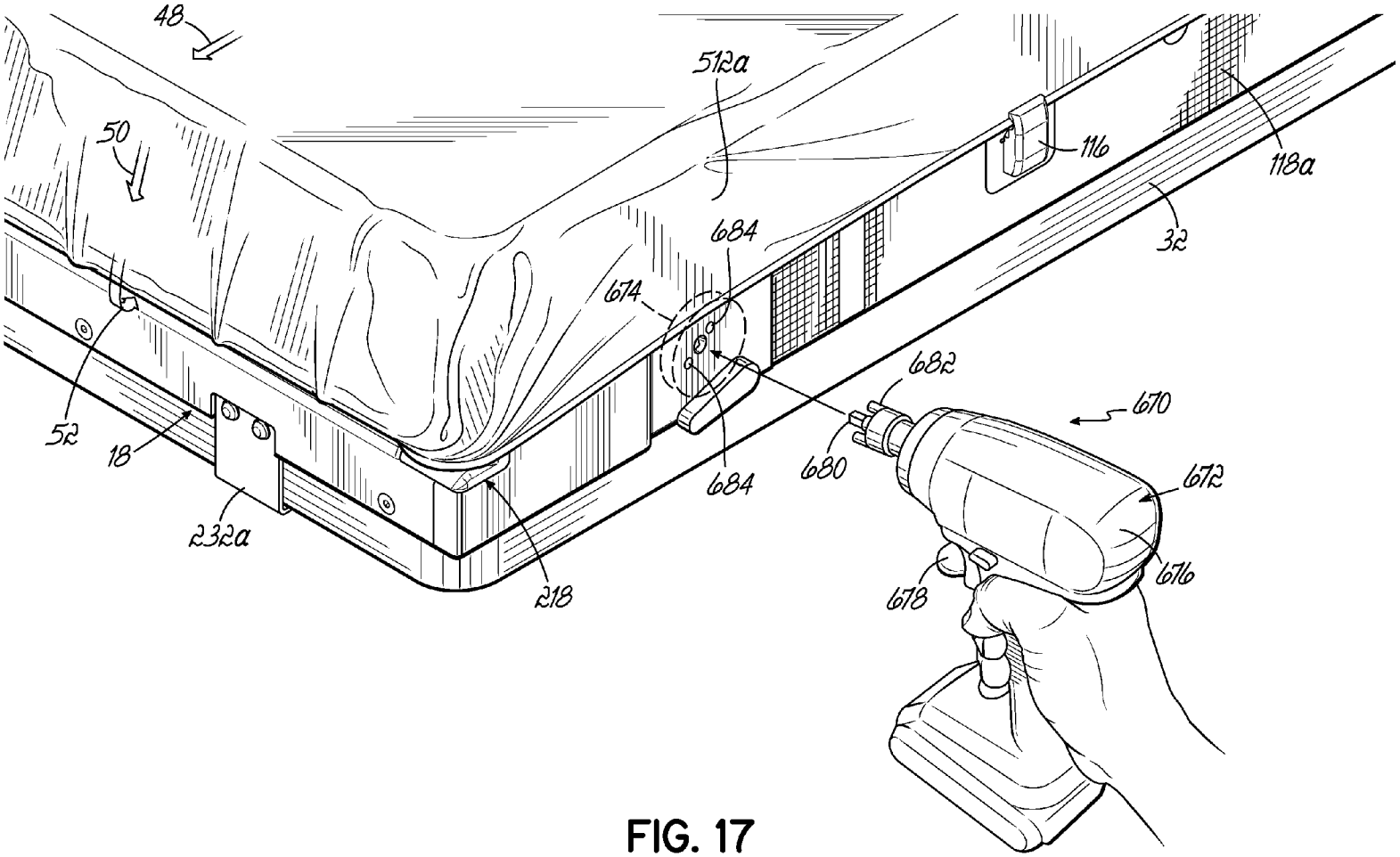
FIG. 17 is an enlarged perspective view which shows another aspect of the patient repositioning system of this invention, namely a hand held unit capable of driving the pulling device from outside the sheet receiver.

With respect to FIG. 17, an alternative embodiment of a drive mechanism 670 includes an external portion 672 of the drive mechanism 670 and an internal portion 674 of the drive mechanism 670 contained within the housing 214. By splitting the drive mechanism 670 into external and internal portions 672, 674, patient care environments with multiple health care beds may purchase less external portions 672 for use with any number of internal portions 674. Specifically, the external portion 672 is hand held and includes an external motor 676 operably driven by an external controller 678. The operator may direct the external controller 678 to rotate the external motor 676 and, in turn, operate the internal portion 674 of the drive mechanism 670 as described above to pull the sheet 16. For instance, a nursing home with a plurality of health care beds 12 may reduce costs by only purchasing one external portion 672 for use with multiple health care beds equipped with a patient repositioning system 10*a*. In other words, FIG. 17 shows an embodiment wherein only a part of the drive mechanism 670 is contained within the housing 214. The other part may be hand held, and driven by a.c. or a battery.

According to an exemplary embodiment, the hand held external portion 672 inserts through a coupling 680 in the housing 214 for operatively connecting to the roller 244 shown in FIG. 6 and FIG. 9. Preferably, the coupling 680 also includes a key member 682 received within a key slot 684 while connected to the internal portion 674 for preventing backlash of the hand held external portion 672. For example, if the external motor 676 suddenly encounters substantial force during use, the external portion 672 may suddenly twist in hand. However, in the event that the key slot 684 receives the key member 682, the sheet receiver 18 will bear the backlash of the twisting force in hand. It will be appreciated that any portions of the drive mechanism 670 may be internal or external of the housing 214 in accordance with the invention described herein.

Figure 18:
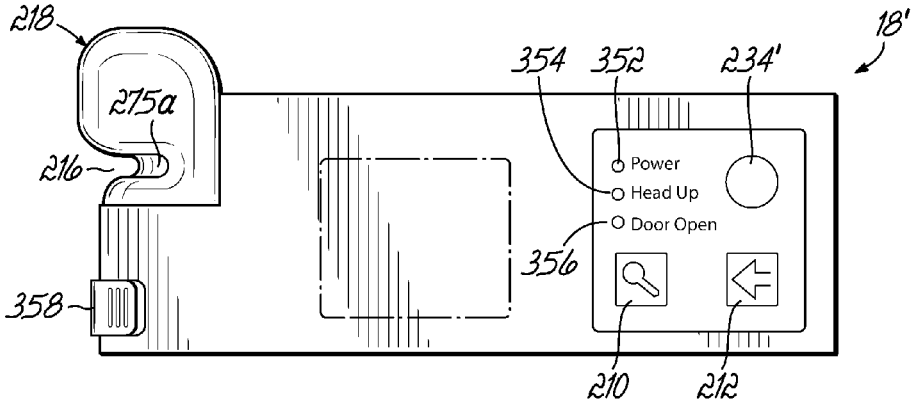
FIG. 18 is a side view of a first preferred embodiment of the sheet receiver.
Figure 19:
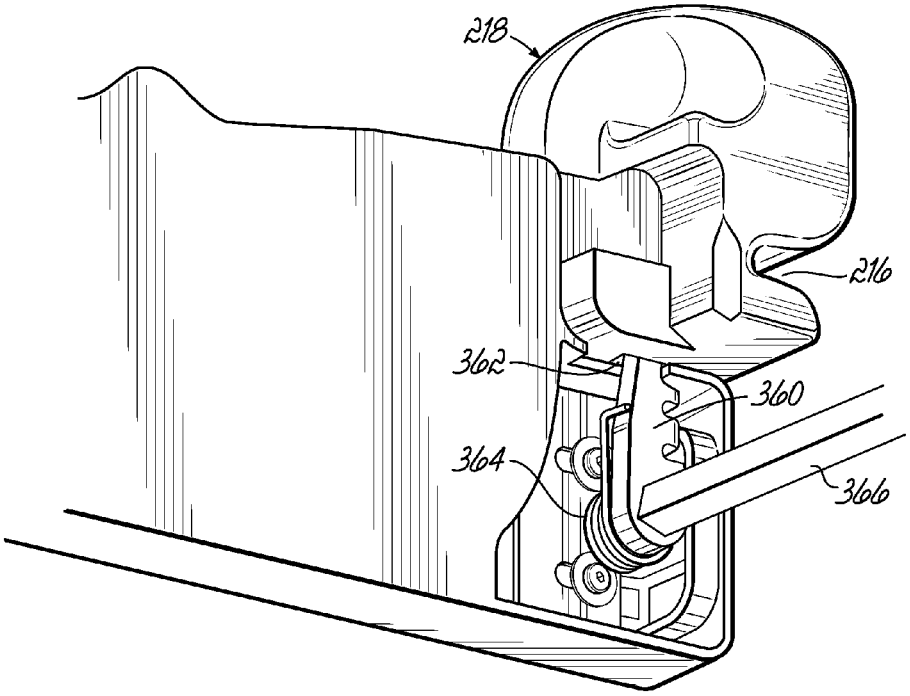
FIG. 19 is a perspective view, from the inside of the sheet receiver and looking outwardly, which shows some details of a latch mechanism for the access door.

FIG. 18 is an alternative embodiment of a sheet receiver 18' having an optional digital and graphic display module 350. The display module 350 is positioned within the side panel 282*a* and operatively connected to the controller 294 (see FIG. 21) for displaying any information discussed herein that may be communicated via the controller 294 and indicated to the operator. The sheet receiver 18' also includes the enabling switch 210 and drive switch 212. According to one embodiment, the drive switch 212 may be the only input needed to operate the sheet receiver 18. Alternatively, the enabling switch 210 and the drive switch 212 inputs both are needed to operate the sheet receiver 18, either concurrently or sequentially.

Furthermore, the sheet receiver 18' includes a plurality of light emitting diodes (LEDs) acting as a power indicator 352, a leveling indicator 354, and an open access door indicator 356. The power indicator 352 emits light to indicate that the sheet receiver 16 is enabled for operation. The leveling indicator 354 emits light to indicate that the sheet receiver 18' is too unlevel for operation. The open access door indicator 356 emits light to indicate that the access door 236 is open and, as such, not ready for operation until the access door 236 is sufficiently closed.

The sheet receiver 18' also includes a sheet release 234' and a door release 358. The sheet release 234' is operatively connected to the clutch 276 (see FIG. 8) for disengagement and releasing of the sheet 16 (see FIG. 7A-7C) as described above. The door release 358 operatively slides to the right, with respect to FIG. 18, in order to release the latch 360. Specifically, as the door release 358 translates, the latch 360 rotates out of a cooperating door slot 362 within the access door 236 for allowing the access door 236 to move as described herein. The latch 360 is biased with a torsion spring 364 for returning the latch 360 and insertion into the door slot 362. As such, the latch 360 locks the access door 236 in the closed position for preventing the taut sheet 16 similar to FIG. 3E from lifting the access door 236 open while being pulled. Furthermore, another latch (not shown) is connected to the latch 360 via the extended bar 366. In this respect, the sheet receiver 18' has two symmetrically positioned latches 360 for locking the access door 236 closed.

Figure 20:
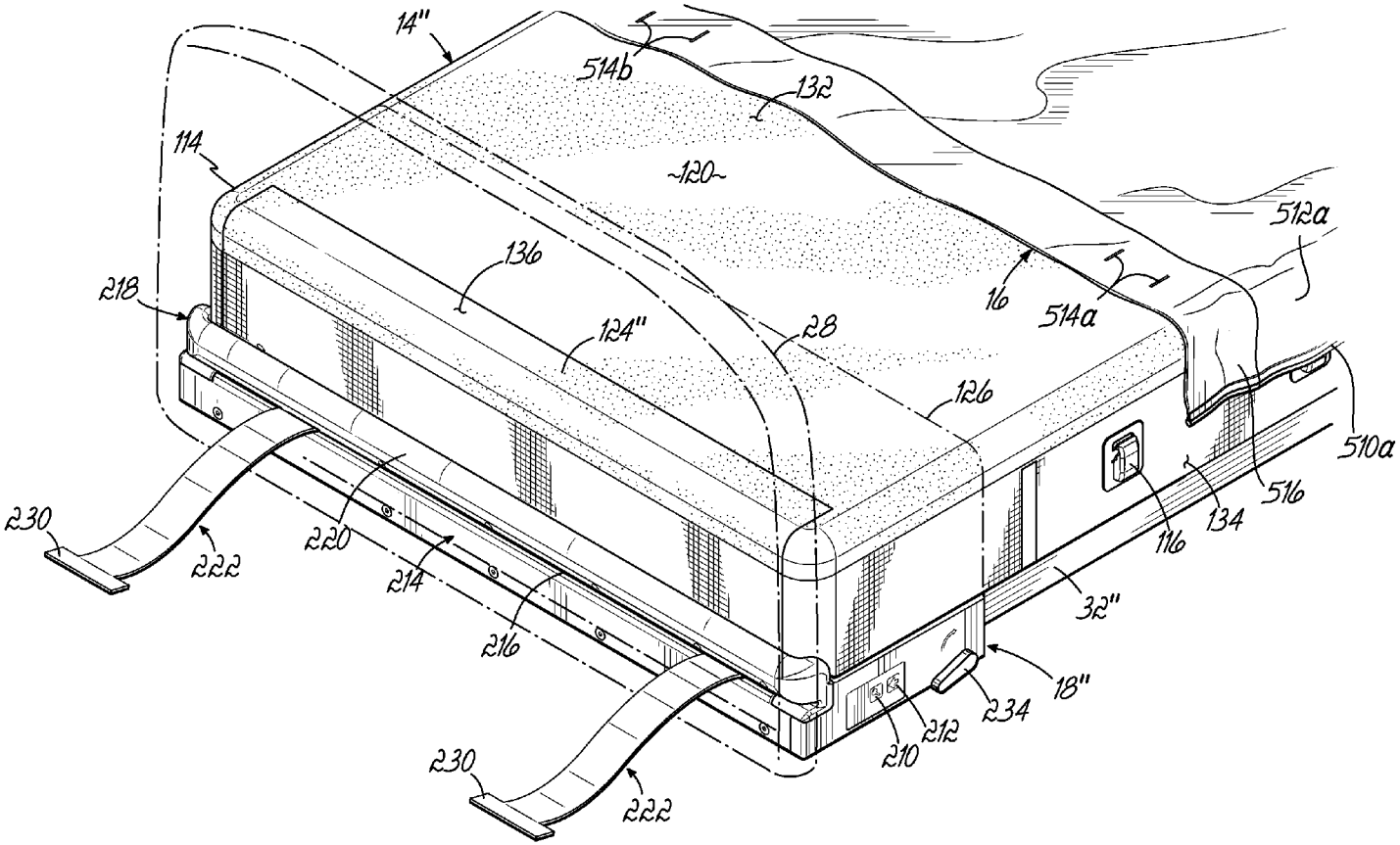
FIG. 20 is an enlarged perspective view that is analogous to the views of FIGS. 3B and 3C, but showing an alternative embodiment, with the sheet receiver integrated with a portion of a bed deck, so that the top of the sheet receiver is contiguous with the top of the bed deck.

FIG. 20 shows another alternative sheet receiver 18" for use with a mattress 14". Notably, the sheet receiver 18" is integrated into the head deck portion 32". Accordingly, the sheet receiver 18" may be used with the mattress 14", which includes a head end section 122" with a substantially uniform thickness throughout. Furthermore, the head end section 122" is substantially the same thickness as the remainder of the mattress 14". While the exemplary embodiment of the sheet receiver 18" is integrated with the head deck portion 32", it will be appreciated that the sheet receiver 18" may alternatively be mounted below the head deck portion 32" for use with the mattress 14" of substantially uniform thickness throughout. In other respects, like numbers indicate like features described above.

Figure 21:
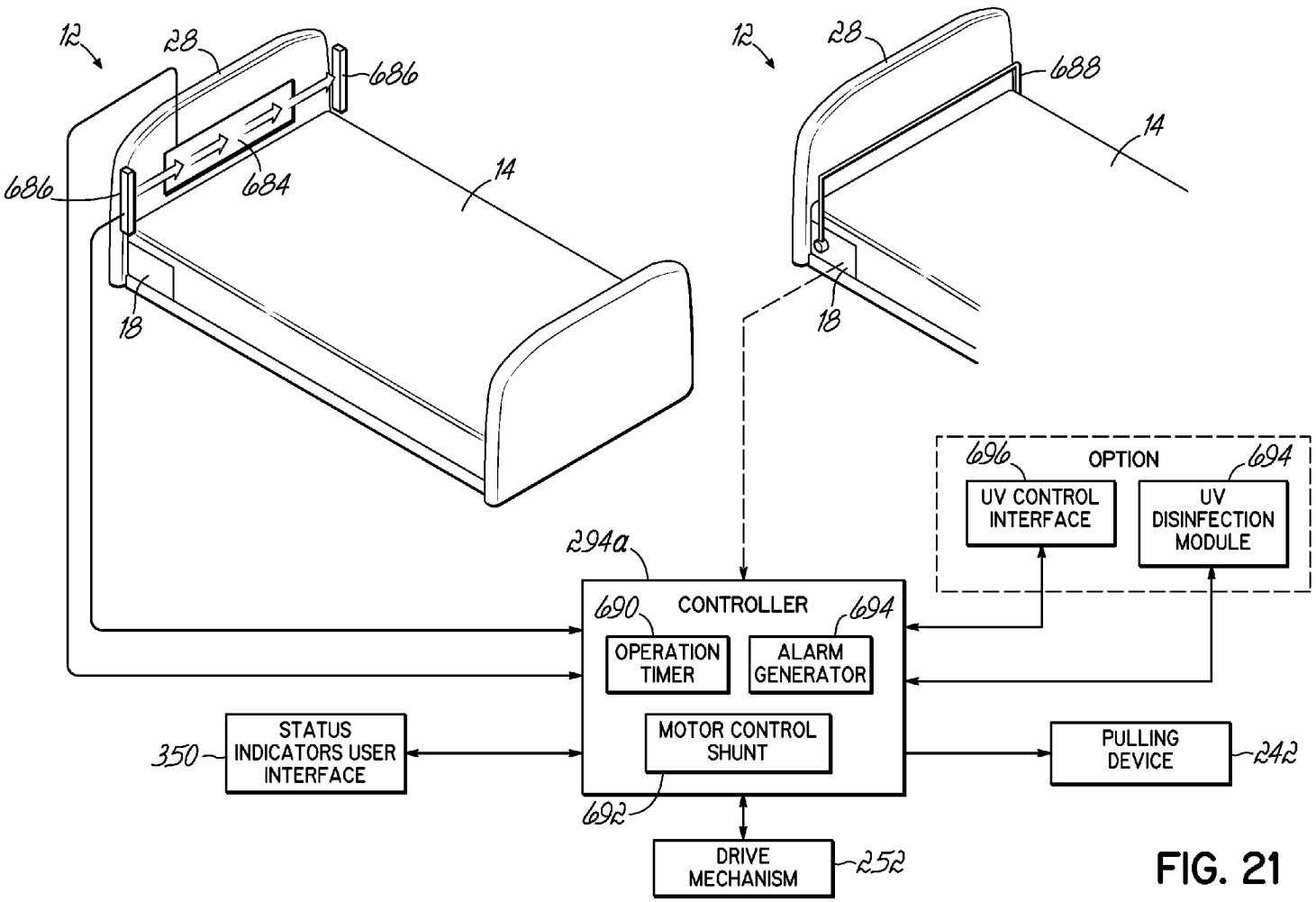
FIG. 21 is a block diagram which schematically shows a control system for communicating with the various components of a patient repositioning system of the type shown and described herein.

With respect to FIG. 21, the controller 294 may be connected to one or more switches for preventing the patient from contacting the headboard 28 during use. According to an exemplary embodiment, a pressure pad 684 senses pressure of patient contact while a light curtain 686 senses the patient breaking the light passing therethrough. Alternatively, the controller 294 may be operatively connected to a trip switch 688 switch operably mounted to the sheet receiver 18. Similarly to the pressure pad 684, in the event that the patient passes too close the head end, the patient contacts the trip switch 688 for communicating the patient's presence to the controller 294. The controller 294 may also maintain the amount of time the sheet receiver 16 operates with an operation timer 690 and the amount of electrical current or rate of electrical current being used by the drive mechanism 252 at any given time.

In any case, the controller 294 is operatively connected to a status indicator, such as the display 350 described above with respect to FIG. 18, the drive mechanism 252, and the pulling device 242. As such, if the operation time 690 reaches a predetermined maximum amount of time, the maximum electrical currents peaks via a motor shunt control 692, or the pressure pad 684, light curtain 686, or trip switch 688 communicates with the controller 294, the controller 294 may remove power from the drive mechanism 252 to stop the patient from moving toward the headboard 28. The controller 294 may also communicate visually via the status indicator 350 or audibly via an operatively connected alarm generator 694

Another option of an exemplary embodiment shows a sheet receiver 18 having a UV disinfection module 694 contained therein for selectively operation. Specifically, the module 694 is connected to a UV control interface that also connects to the controller 294. As such, the operator may selectively operate the UV disinfection module 694, or the controller 294 may maintain the operation time 690 for periodic disinfection.

According to another exemplary embodiment, the patient repositioning device 10 may be used as substantially described above with respect other types of beds. For example, the patient repositioning device 10 may be used with a birthing bed described within U.S. Pat. No. 6,757,924, the disclosure of which is hereby incorporated by reference herein. In this respect, the mattress is sized and shaped so as to accommodate the removal of the foot section of the birthing bed. By way of another example, the patient repositioning device 10 may also be used with a bed described within U.S. Pat. No. 5,692,256, the disclosure of which is hereby incorporated by reference herein. In this respect, the mattress has a non-uniform thickness with respect to a central lateral vertical plane. Of course, the patient repositioning device 10 may be configured to accommodate a conventional bed or any other bed for which repositioning the patient provides increased comfort and performance to both the operator and the patient.

In use, with a patient supported on the sheet 16 and the sheet 16 located on the mattress 14, this patient repositioning system 10 enables an attendant to cause the sheet 16 and the patient supported thereon to move toward the head end 30 of the mattress 14, as the sheet 16 is pulled into the slot 216 formed in the housing 214. Because the sheet 16 has a width that is greater than that of the mattress 14, and that additional width is retained along opposing longitudinal sides of the mattress 14, as the sheet 16 moves and the patient is repositioned the outer portions of the sheet 16, i.e. the sheet longitudinal sides 412*a*, 512*b* move from a substantially vertical orientation to a substantially horizontal orientation as the sheet 16 is pulled into the slot 216. For each sheet 16, a number of such patient repositionings may occur, until the system 10 indicates via the sheet usage indicia 522 that it is time to replace the sheet 16. Generally, the attendant causes the sheet 16 to move via operation of the inputs to the drive mechanism 252, as described above.

To initiate patient repositioning using this system, an attendant places a sheet 16 on the mattress 14, connects the sheet 16 to the mattress 14, and also operatively couples the sheet 16 to the drive mechanism 252. Typically, this connecting of the sheet 16 to the mattress 14 involves securing opposite sheet longitudinal sides 512*a*, 512*b* of the sheet 16 to oppositely located rows of retainers 116 spaced along the length of the mattress 14, and the sheet 16 has beaded edges 510, 510*b* along its longitudinal sides 512*a*, 512*b* which allow for longitudinal movement of the sheet 16 along the retainers 116. To operatively couple the sheet 16 to the drive mechanism 252, the attendant which may also be referred to as an operator, releasably attaches the sheet 16 to the drive mechanism 252, and the drive mechanism 252 is then used to pull the sheet 16 toward the head end 30 of the mattress 14, to "load" the sheet 16 in preparation for subsequent pullings of the sheet 16 toward the head end 30 of the mattress 14 with a patient residing thereon.

In some situations, it may be necessary to replace a sheet 16 on a mattress 14 while a patient remains thereon, perhaps due to soiling of the sheet 16, or other reasons. In this situation, after removal of the old sheet 16, the attendant retains a first beaded edge 510*a* of a first longitudinal side 512*a* of the new sheet 16 to the row of spaced retainers located on one side of the mattress 14. Thereafter, the patient and the sheet 16 are maneuvered so as to place the sheet 16 between the patient and the mattress 14, and then the attendant retains the second beaded edge 510*a* of the opposite, second longitudinal side 510*b* of the new sheet 16 to the second row of spaced retainers 116 located on the second side of the mattress 14. Once the sheet 16 has been retained on both sides of the mattress 14, the sheet 16 is then releasably attached to a drive mechanism 252 located adjacent the head end 30 of the mattress 14, and the sheet 16 is thereafter pulled toward the head end 30 of the mattress 14 to "load" the system. Typically, during this initial pulling, the head end of the sheet 16 is not weight bearing, i.e., the patient is not residing thereon. Stated alternatively, the new sheet 16 is retained on the mattress 14 with some amount of slack at the head end 30 thereof, as indicated by indicia on the new sheet 16, to facilitate unweighted pulling of the sheet 16 to the loaded position.

In addition to these methods as described above, this patient repositioning system 10 also facilitates infection control, or even retrieval of the sheet 16, by facilitating access to the housing 214 into which the sheet 16 is pulled. More particularly, to access the inside of the housing 214, the attendant merely needs to open the access door 236 to the housing 214. There is no need to raise any portion of the bed. Depending on the configuration of the patient repositioning system 10 and the structure of the bed, this opening of the access door 236 may occur after moving the head end piece 124 of the mattress 14, as by folding. Moreover, this opening the access door 236 may involve manipulation of the bottom of the mattress 14, or the top of the bed deck 22, depending on how the housing 214 is configured with respect to the mattress 14 and/or the bed deck 22.

This specification shows and describes several preferred embodiments of the invention. However, those skilled in the art will appreciate that the disclosed embodiments are susceptible to a reasonable amount of modification and/or permutation, without departing from the overall scope of the invention. For instance, the dimensions of the components shown and described, and/or the relationships of those dimensions to other components may vary, as needed, in order to apply the general principles of the present invention to the actual circumstances at hand.

Moreover, it is to be understood that the recitation of "objects of the invention" in this specification, or references problem recognized in the prior art, are not intended to be construed as an admission that others have also recognized the same problems or perceived the same limitations in the state of the art, as recognized by the present inventors. Moreover, any reference to objects of the invention is not intended to require each of the following claims to achieve all of the above-stated objects or advantage. Rather, the recitation of the objects of the invention in this specification is intended merely to help explain the story behind the present invention, and to explain why the present invention represents an advance in the state of the art over existing technology. Accordingly, the inventors intend that the scope of the appended claims is not to be limited by the specific details shown or described in this specification.

We claim:

1. A patient repositioning system comprising:

a mattress having a head end and a foot end and an upper surface and opposing longitudinal sides;

a sheet residing on the upper surface;

a pulling device operatively connected to the sheet and adapted to pull the sheet toward the head end with a patient residing thereon, thereby to reposition the patient;

a housing holding the pulling device;

an arrestor operatively connected to the pulling device and adapted to normally hold the sheet in place so as to prevent movement of the sheet toward the foot end of the mattress, and operable to selectively enable the sheet to be repositioned, reversed, or removed from the housing; and a hand held device operable to selectively cooperate with the housing so as to actuate the pulling device from outside the housing, thereby to enable the patient to be repositioned from outside the housing.

2. The patient repositioning system of claim 1 wherein the sheet further includes sheet usage indicia for indicating at least one of: the amount of sheet remaining to be advanced, the amount of sheet that has been already advanced, and the positional relationship of the sheet length relative to the mattress.

3. The patient positioning system of claim 1 wherein the hand held device contains at least one of: a motor, a clutch and a gear set.

4. The patient repositioning system of claim 1 wherein the hand held device is operable to selectively cooperate with the housing from a position located laterally beyond one of the longitudinal sides of the mattress.

5. A patient repositioning system comprising:

a mattress having a head end and a foot end, and an upper surface;

a sheet residing on the upper surface;

a drive mechanism, the drive mechanism operatively connected to the sheet and adapted to pull the sheet toward the head end with a patient residing thereon, thereby to reposition the patient; and a housing holding at least a part of the drive mechanism, the housing containing an access door, the access door providing access to an inside of the housing, whereby upon deactivation of the drive mechanism, after having pulled the sheet toward the head end of the mattress, the drive mechanism reverses to reduce the tightness in the sheet.

6. The patient repositioning system of claim 5 further comprising;

a bed having a head end deck with a top surface, the housing being at least partially located below the top surface of the head end deck.

7. The patient repositioning system of claim 6 wherein the head end deck comprises the access door.

8. A method of repositioning a patient supported on a sheet that is located on a mattress, the mattress having a head end and a foot end and being supported by a bed frame, comprising:

causing the sheet and the patient supported thereon to move toward the head end of the mattress, whereby the causing further includes pulling the sheet into a slot formed in a housing located below the upper surface of the head end of the mattress, the sheet being of a width greater than that of the mattress and being retained along opposing longitudinal sides of the mattress.

9. The method of claim 8 wherein outer portions of the sheet move from a substantially vertical orientation to a substantially horizontal orientation as the sheet is pulled into the housing.

10. The method of claim 8 and further comprising:

operating a hand held device, from outside the housing, to produce the causing.

11. The patient repositioning system of claim 8 wherein with respect to a central longitudinal vertical plane the housing and the mattress are complementary in shape.

12. A method of repositioning a patient supported on a sheet that is located on a mattress, the mattress having a head end and a foot end and being supported by a bed frame, comprising:

placing a sheet on the mattress and connecting the sheet to the mattress and operatively coupling the sheet to a drive mechanism to thereby enable the sheet to be pulled toward a head end of the mattress, the drive mechanism located within a housing located below a head end of the mattress, the connecting including securing the opposite sides of the sheet to oppositely located rows of retainers spaced along the length of the mattress, and the sheet having beaded edges along its longitudinal sides to allow for longitudinal movement of the sheet relative to the mattress.

13. The method of claim 12 wherein each of the retainers has an open position and a closed position, the closed position defining a channel for the beaded edge of the sheet.

14. The method of claim 12 wherein the operatively coupling of the sheet to the drive mechanism further comprises:

releasably attaching the sheet to the drive mechanism; and moving the sheet toward the drive mechanism for a desired distance, thereby to prepare the sheet for subsequent moving toward the head end with a patient thereon.

15. The method of claim 12 wherein the sheet is releasably attached to the drive mechanism via at least one reinforced slit formed in the sheet.

16. A method of maintaining a patient repositioning system, wherein the patient repositioning system pulls a sheet toward a head end of a mattress residing on an articulating bed, comprising:

opening an access door of a housing into which the sheet is pulled, the housing located adjacent the head end, thereby to access an inside of the housing, wherein the opening occurs without a corresponding need to raise any part of the articulating bed.

17. The method of claim 16 wherein the articulating bed includes a bed deck and the bed deck comprises the access door.

18. The method of claim 16 further comprising:

moving a mattress head end piece prior to the opening of the access door.

19. The method of claim 16 wherein the mattress includes a lower surface and the lower surface comprises the access door.

20. A sheet for use in a patient repositioning system, wherein the patient repositioning system further includes a mattress having a head end and a foot end, and an upper surface, a sheet residing on the upper surface, a drive mechanism, the drive mechanism operatively connected to the sheet and adapted to pull the sheet toward the head end with a patient residing thereon, thereby to reposition the patient, and a housing holding at least a part of the drive mechanism, the housing containing an access door, the access door providing access to an inside of the housing, wherein the mattress has opposing vertical side walls and the system further comprises two rows of spaced retainers extending along the length of the mattress, each of the rows including a plurality of discretely spaced retainers located on one of the vertical side walls and adapted to capture a corresponding side of the sheet and to retain said captured corresponding side as the sheet moves toward the head end during repositioning, and further comprising at least one of:

sheet loaded indicia located on the sheet, whereby when the drive mechanism has pulled the sheet a predetermined length, the sheet loaded indicia indicate that the sheet has moved a predetermined length, and sheet usage indicia located on the sheet, whereby the sheet usage indicia indicate at least one of the following: the amount of the sheet that remains to be used, the amount of the sheet already advanced, and the positional relationship of the sheet length relative to the mattress.

21. The sheet of claim 20 wherein the sheet loaded indicia is detectable on either side of the sheet.

22. The sheet of claim 20 wherein the sheet loaded indicia cooperatively interact with at least one of the mattress, the housing, and the bed frame to enable a user to readily determine when the sheet loaded indicia is aligned with the corresponding indicia.

23. The sheet of claim 20 wherein the sheet has at least one of a width greater than the width of the mattress and a length more than about twice the length of the mattress.

24. The sheet of claim 20 wherein the sheet has beaded edges adjacent both longitudinal side edges.

25. The sheet of claim 20 wherein the sheet has at least one reinforced slit adapted to operatively couple the drive mechanism.

26. A sheet for use in a patient repositioning system having a mattress and a drive mechanism adapted to pull the sheet toward a head end of the mattress, comprising at least one of:

sheet loaded indicia located on the sheet, whereby when the drive mechanism has pulled the sheet a predetermined length, the sheet loaded indicia indicate that the sheet has moved a predetermined length, and sheet usage indicia located on the sheet, whereby the sheet usage indicia indicate at least one of the following: the amount of the sheet that remains to be used, the amount of the sheet already advanced, and the positional relationship of the sheet length relative to the mattress, wherein the sheet further includes a coded section adapted to cooperate with the drive mechanism to assure proper compatibility of the sheet with the drive mechanism.

27. The sheet of claim 26 wherein the coded section comprises at least one of: an RFID component, magnet, and a barcode.

28. An apparatus adapted for use in combination with a bed having a deck, a mattress residing on the deck and having a foot end and a head end and an upper surface, a sheet residing on the mattress, and a drive mechanism located below the upper surface near the head end of the mattress and operable to pull the sheet toward the head end of the mattress, comprising:

a housing adapted to be secured to the deck and which contains at least a part of the drive mechanism, the housing including a slot extending along the housing, and wherein the drive mechanism is operable to pull the sheet into the housing via the slot, the housing further including an access door movable relative to the housing thereby to permit access to the inside of the housing.

29. The apparatus of claim 28 and further comprising:

a connecting structure having first and second ends, with the first end thereof secured to the pulling device and the second end thereof adapted to be releasably attached to the sheet, the connecting structure being of sufficiently small dimension so as to pass through the slot.

30. The apparatus of claim 29 wherein the pulling device comprises a roller having a central portion and opposing outer portions, and the outer portions have a reduced diameter to accommodate any excess width of the sheet which extends beyond the width of the mattress.

31. The apparatus of claim 28 and further comprising:

a pulling device mounted within the housing, operatively connected to the drive mechanism and also operatively coupled to the sheet, whereby upon activation of the drive mechanism the pulling device pulls the sheet into the housing via the slot.

32. The apparatus of claim 31 wherein the drive mechanism further comprises:

a hand held device operable to activate the pulling device from outside the housing.

33. A mattress for use in a patient repositioning system having a sheet and a drive mechanism adapted to pull the sheet toward a head end of the mattress, the drive mechanism located at least in part in a housing, comprising:

a first row of spaced retainers located along a first side of the mattress; and a second row of spaced retainers located along a second side of the mattress, opposite the first side, the retainers adapted to retain the sheet during pulling of the sheet toward the head end of the mattress by the drive mechanism, wherein each of the retainers has a closed position so as to define a channel for retaining a corresponding longitudinal side of the sheet, and an open position to facilitate removal of the sheet from the channel.

34. The mattress of claim 33 wherein the rows of retainers are located on opposite longitudinal sides of the mattress.

35. A sheet receiver for a patient repositioning system used on a bed, the bed having a bed deck and the bed deck including at least one section that articulates relative to another section thereof, the sheet receiver comprising:

a housing adapted to be supported at a first end of a bed deck, the first end being part of said at least one section of the bed deck that articulates relative to said another section thereof;

a pulling device located in the housing, and located primarily within an internal compartment of the housing;

the housing having an access door adapted to open and to close so as to provide access to the internal compartment, the housing also having an elongated slot extending along a first end thereof; and a connector having an innermost end secured to the pulling device within the internal compartment and an outermost end removably attachable to a sheet located on a mattress supported on the bed deck, wherein the pulling device and the connector are adapted to pull the sheet with a patient supported thereon so as to move the patient and the sheet relative to the mattress toward the first end, and the outermost end of the connector, with the sheet removably attached thereto, is sized to as be pulled through the slot into the housing.

36. The sheet receiver of claim 35 wherein the slot length is shorter than the length of the internal compartment of the housing.

37. The sheet receiver of claim 35 wherein the connector has at least one opening at the innermost end, thereby to facilitate cleaning of the internal compartment and the pulling device when the access door is open.

38. The sheet receiver of claim 35 further comprising a structure extending along the outermost end of the connector, the structure having opposite ends, each of which is adapted to operatively connect to a corresponding slit in the sheet.

39. The sheet receiver of claim 38 wherein the structure is a rod.

40. The sheet receiver of claim 38 wherein the structure is flexible but is substantially straight when no forces are exerted thereon.

41. A sheet receiver for a patient repositioning system comprising:

a housing adapted to be supported at a first end of a bed deck;

a pulling device located in the housing, and located primarily within an internal compartment of the housing;

the housing having an access door adapted to open and to close so as to provide access to the internal compartment, the housing also having an elongated slot extending along a first end thereof; and a connector having an innermost end secured to the pulling device within the internal compartment and an outermost end removably attachable to a sheet located on a mattress supported on the bed deck, and the outermost end of the connector, with the sheet attached thereto, is configured to extend through the slot so that, upon actuation of the pulling device, the outermost end and the sheet removably attached thereto can be pulled through the slot and into the housing.

42. The sheet receiver of claim 41 wherein the pulling device and the connector are adapted to pull the sheet with a patient supported thereon so as to move the patient and the sheet relative to the mattress toward the first end.

43. A method of placing a sheet on a mattress while a patient is lying thereon, the mattress having a head end and a foot end, and the sheet having beaded edges along its longitudinal sides, comprising:

retaining a first beaded edge of a first longitudinal side of the sheet to a first row of spaced retainers located on a first side of the mattress;

after maneuvering the patient and the sheet so as to place the sheet between the patient and the mattress, retaining a second beaded edge of a second longitudinal side of the sheet to a second row of spaced retainers located on a second side of the mattress; and releasably attaching the sheet to a drive mechanism located adjacent the head end of the mattress, and thereafter pulling the sheet toward the head end of the mattress.

44. The method of claim 43 wherein the sheet is retained with a predetermined leading end length of the sheet located adjacent the head end, and thereafter pulling occurs until the predetermined leading end length has moved beyond the head end of the mattress.

45. A patient repositioning system including a sheet located on a mattress, the mattress having a head end and a foot end and being supported by a bed frame, comprising:

means for causing the sheet and the patient supported thereon to move toward the head end of the mattress, said means for causing operable to pull the sheet into a slot formed in a housing located below the upper surface of the head end of the mattress, the sheet being of a width greater than that of the mattress and being retained along opposing longitudinal sides of the mattress; and a hand held device located outside the housing and operable to temporarily engage the housing so as to cooperate with the means for causing, in order to pull the sheet into the slot.

46. The patient repositioning system of claim 45 wherein the hand held device contains at least one of: a motor, a clutch and a gear set.

47. A mattress for use in a patient repositioning system having a sheet and a drive mechanism adapted to pull the sheet toward a head end of the mattress, the drive mechanism located at least in part in a housing, comprising:

the mattress including a head end piece that is movable relative to the rest of the mattress, thereby to enable access to the housing when the housing is located below an upper surface of the mattress, and further wherein, with respect to a central longitudinal vertical plane, the head end section of the mattress is complementary in shape relative to the location of the housing.

* * * * *